US012258739B2

(12) United States Patent
Muraoka et al.

(10) Patent No.: US 12,258,739 B2
(45) Date of Patent: Mar. 25, 2025

(54) KINETIC FAUCET AND SINK ASSEMBLIES

(71) Applicant: Kohler Co., Kohler, WI (US)

(72) Inventors: Hiroyuki Chanseol Muraoka, New York, NY (US); Daniel Brohn, Kohler, WI (US); Karger David Kohler, Kohler, WI (US); Ka Ming Larry Yuen, Kohler, WI (US)

(73) Assignee: Kohler Co., Kohler, WI (US)

( * ) Notice: Subject to any disclaimer, the term of this patent is extended or adjusted under 35 U.S.C. 154(b) by 216 days.

(21) Appl. No.: 17/931,008

(22) Filed: Sep. 9, 2022

(65) Prior Publication Data

US 2023/0098862 A1 Mar. 30, 2023

Related U.S. Application Data

(60) Provisional application No. 63/250,958, filed on Sep. 30, 2021.

(51) Int. Cl.
*E03C 1/04* (2006.01)
*E03C 1/18* (2006.01)

(52) U.S. Cl.
CPC ..... *E03C 1/0404* (2013.01); *E03C 1/18* (2013.01)

(58) Field of Classification Search
CPC ... E03C 1/0404; E03C 1/18; E03C 2001/0415
USPC ..... 4/675–678; 137/801
See application file for complete search history.

(56) References Cited

U.S. PATENT DOCUMENTS

2005/0103903 A1* 5/2005 Shamir ..... F16L 11/18 239/587.2
2019/0368172 A1* 12/2019 Chung ..... F16L 11/18

* cited by examiner

*Primary Examiner* — Tuan N Nguyen
(74) *Attorney, Agent, or Firm* — Husch Blackwell LLP

(57) ABSTRACT

A faucet assembly includes a faucet. The faucet includes a base movably coupled to a mounting surface having a first side and a second side. The faucet includes a spout rotatably coupled to the base. The spout includes a plurality of conduits each rotatably coupled to each other by an angled joint. The spout extends from the base to a free end comprising an outlet to discharge a fluid. A first conduit of the plurality of conduits can rotate relative to the base from a first rotational position towards a second rotational position and a second conduit of the plurality of conduits can rotate in response to the rotation of the first conduit.

21 Claims, 25 Drawing Sheets

FIG. 24
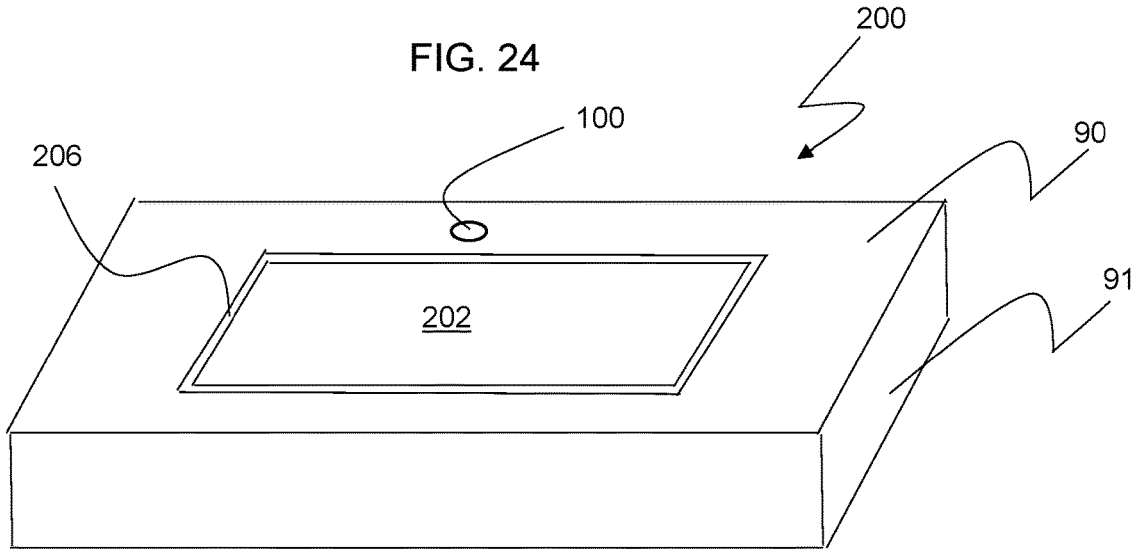
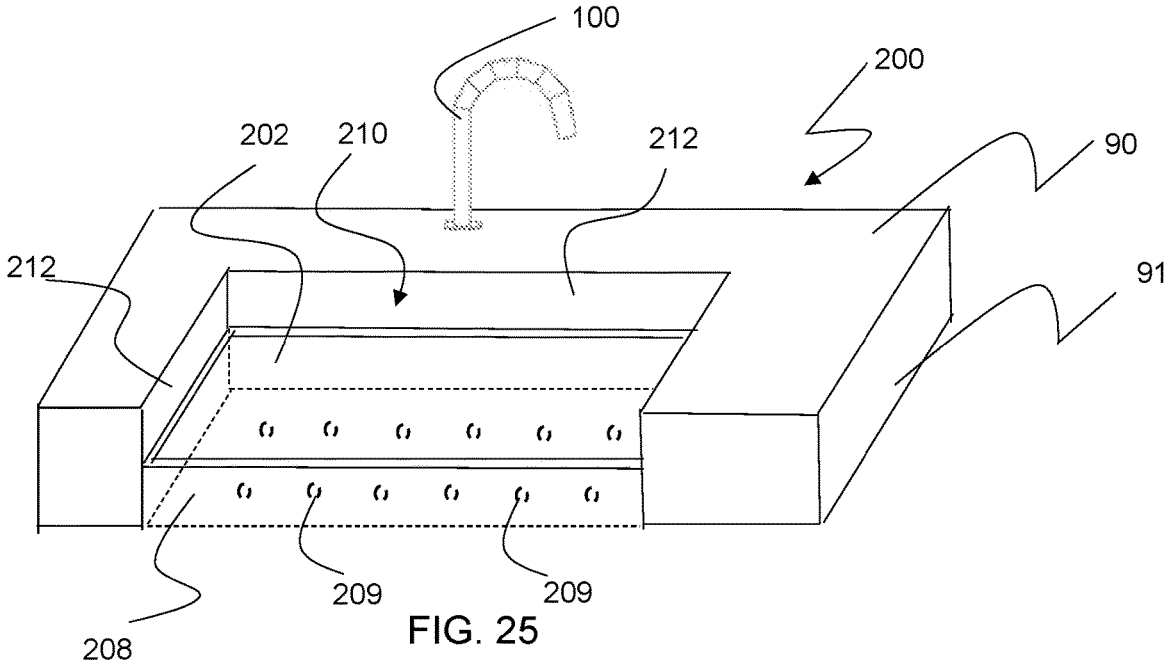
FIG. 25

KINETIC FAUCET AND SINK ASSEMBLIES

CROSS REFERENCE TO RELATED APPLICATIONS

The present application claims the benefit of U.S. Provisional Application No. 63/250,958, filed on Sep. 30, 2021, the disclosure of which is incorporated by reference in its entirety herein.

BACKGROUND

The present disclosure relates generally to faucets and sinks. More specifically, the present disclosure relates to faucets that include spouts having segments that articulate to change the shape of the spout and to reposition an outlet of the faucet, and to a movable sink basin assembly in which the sink basin that can completely be flush with a countertop.

SUMMARY

One embodiment of the present disclosure relates to a faucet assembly. The faucet assembly can include a faucet having base movably coupled to a mounting surface having a first side and a second side. The faucet can include a spout rotatably coupled to the base. The spout can include a plurality of conduits each rotatably coupled to each other by an angled joint. The spout can extend from the base to a free end having an outlet to discharge a fluid. A first conduit of the plurality of conduits can rotate relative to the base from a first rotational position towards a second rotational position and a second conduit of the plurality of conduits can rotate in response to the rotation of the first conduit.

Another embodiment of the present disclosure relates to a faucet. The faucet can include a base movably coupled to a mounting surface having a first side and a second side. The faucet can include a spout rotatably coupled to the base. The spout can include a plurality of conduits each rotatably coupled to each other by an angled joint. The spout can extend from the base to a free end having an outlet to discharge a fluid. A first conduit of the plurality of conduits can rotate relative to the base from a first rotational position towards a second rotational position and a second conduit of the plurality of conduits can rotate in response to the rotation of the first conduit.

Another embodiment of the present disclosure relates to an articulating sink assembly. The articulating sink assembly can include a sink base movably coupled to a cabinet including a mounting surface. The movable sink base can be shifted from a first position in which the sink base is flush with a top side of the mounting surface such that it is "hidden" and forms part of the top side of the mounting surface, to multiple second positions below the mounting surface thereby forming a sink basin having multiple depths. The sink base can include structure defining a perimeter drain about its perimeter for draining water from the base. Alternatively or additionally, the sink base can include a one or more drain holes formed therein. The drain holes can be movable between a closed position when the sink base is in the first position to obscure the one or more drain holes, and an open position when the sink base is in one or more of the second positions. In a non-limiting embodiment, an articulating faucet assembly according to embodiments herein, which is movable from a first position in which the faucet assembly is below mounting surface and the sink base is in the first position to obscure the faucet assembly, to one or more second positions for dispensing fluid when the sink base is in one or more of the second positions. The faucet assembly can move in cooperation with or independently from the movable sink assembly.

BRIEF DESCRIPTION OF THE DRAWINGS

FIG. 24 is a front perspective view of a movable sink assembly in a first position, according to an exemplary embodiment.

FIG. 25 is a front cross-sectional view of an interior portion of a movable sink assembly in a second position, according to an exemplary embodiment.

DETAILED DESCRIPTION

Referring generally to the FIGURES, disclosed herein are kinetic faucet assemblies that control operation of a faucet (e.g., position of the faucet, flow of water, temperature of water, etc.) based on articulation (e.g., rotation, sliding, etc.) of a part of the faucet, such as a spout or base, relative to another part of the faucet assembly, such as a mounting surface. The faucet assemblies disclosed herein can, for example, move the faucets from a first location beneath a mounting surface to a second location above the mounting surface, and can further control positioning of various portions of the faucets a plurality of articulations (e.g., rotations) of the spout (and portions thereof) relative to a base. The faucets of the present disclosure advantageously allow for clean and aesthetically pleasing designs (e.g., designs without handles and other separate controllers), while providing intuitive control of the functionality of the faucet. The faucet assemblies of this applicant can facilitate automatic cleaning of one or more portions of the faucets and can further control positioning of a fluid outlet of the faucets relative to another portion of the faucet assemblies, such as a countertop.

In some embodiments, the kinetic faucet assembly described herein may include some or all of the features of any of the faucet assemblies described in U.S. patent application Ser. No. 16/429,981 filed on Jun. 3, 2019, U.S. patent application Ser. No. 16/429,970 filed on Jun. 3, 2019, U.S. patent application Ser. No. 17/112,939 filed on Dec. 4, 2020, U.S. patent application Ser. No. 16/284,769 filed on Feb. 25, 2019, U.S. patent application Ser. No. 17/473,271 filed on Sep. 13, 2021, U.S. patent application Ser. No. 16/284,707 filed Sep. 25, 2019, and U.S. patent application Ser. No. 15/982,719 filed on May 17, 2018, the entire disclosures of which are incorporated by reference herein in their entirety.

Figure 1:
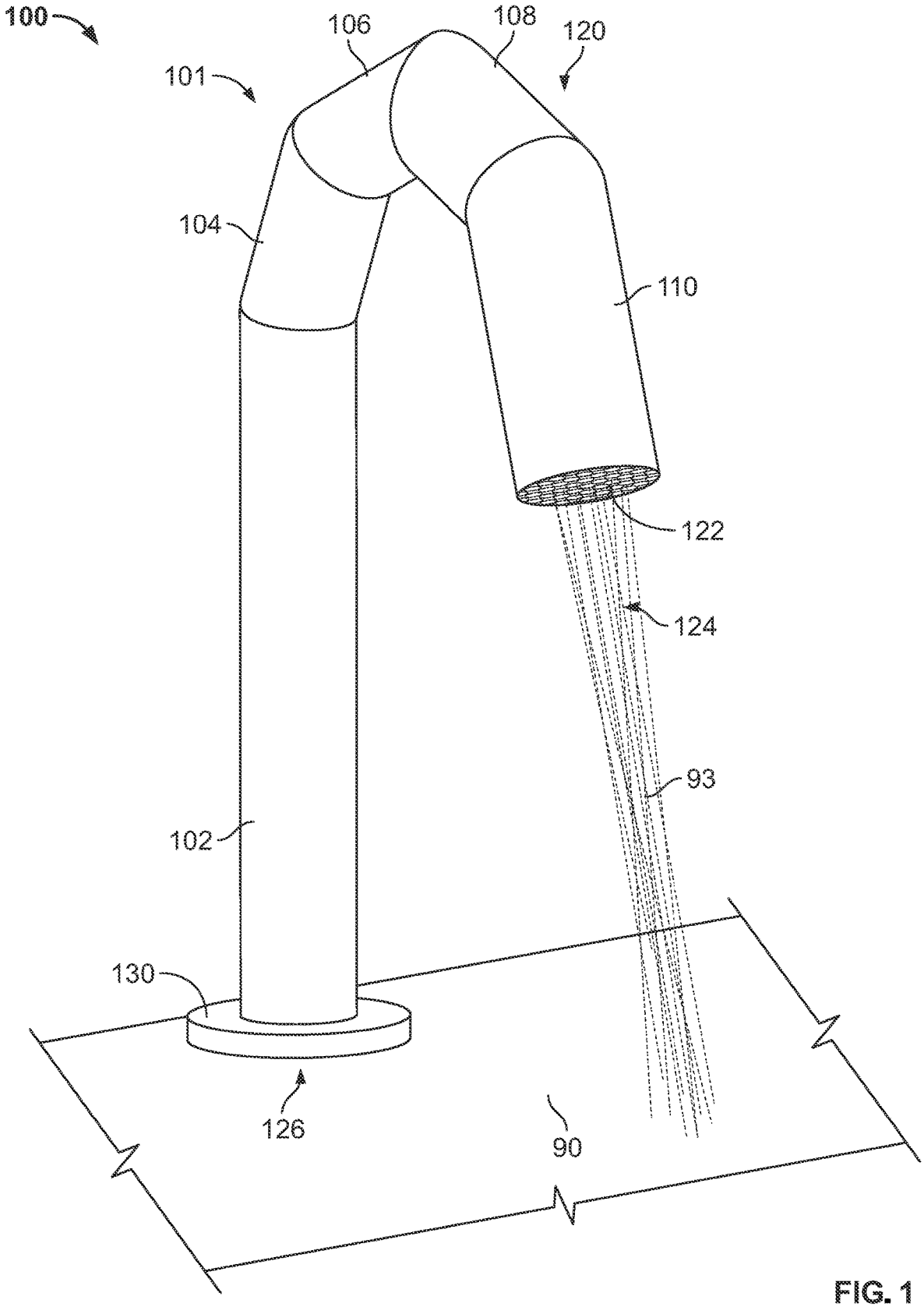
FIG. 1 is a front perspective view of a faucet in a use position, according to an exemplary embodiment.
Figure 2:
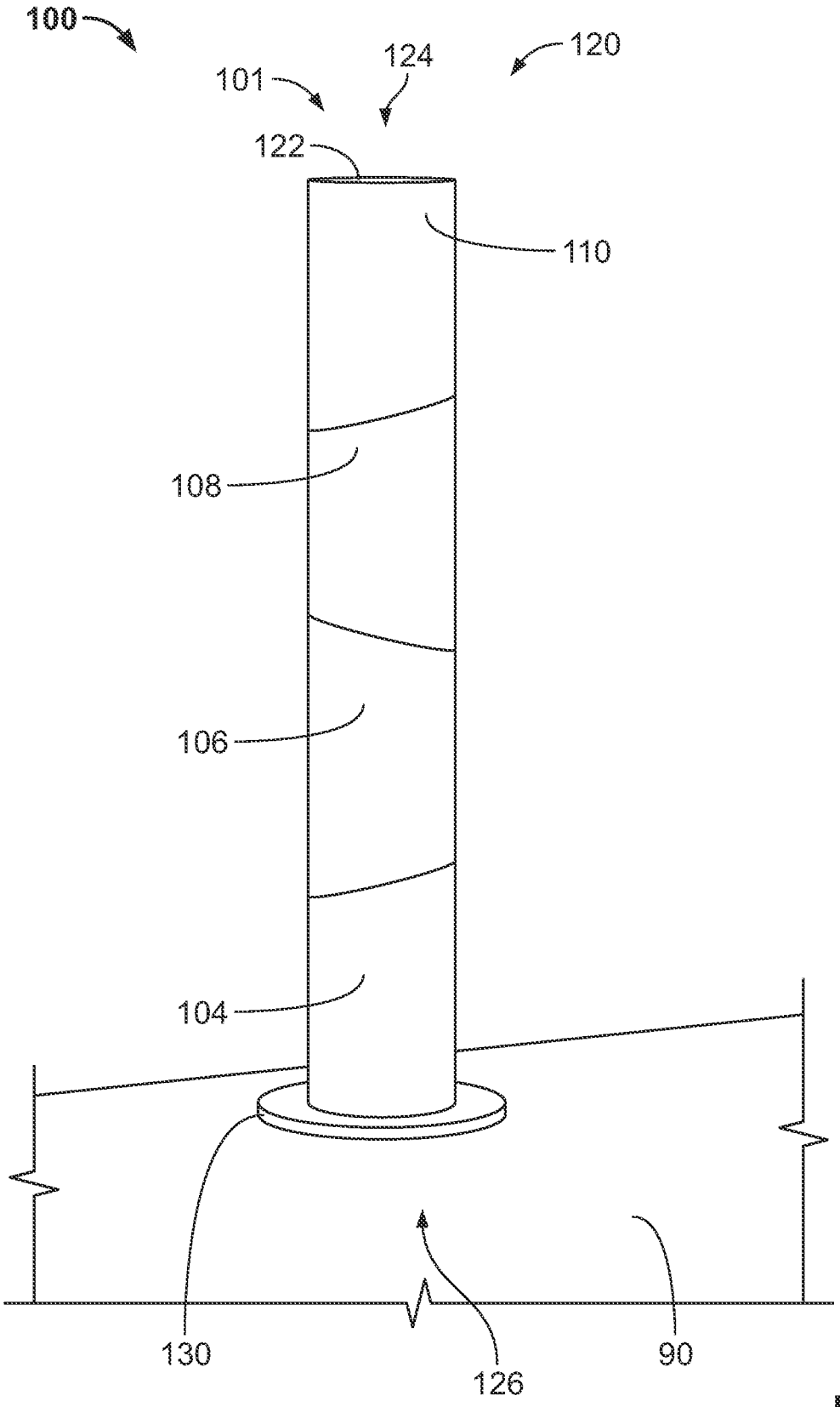
FIG. 2 is a front perspective view of the faucet of FIG. 1 in a moving position, according to an exemplary embodiment.
Figure 3:
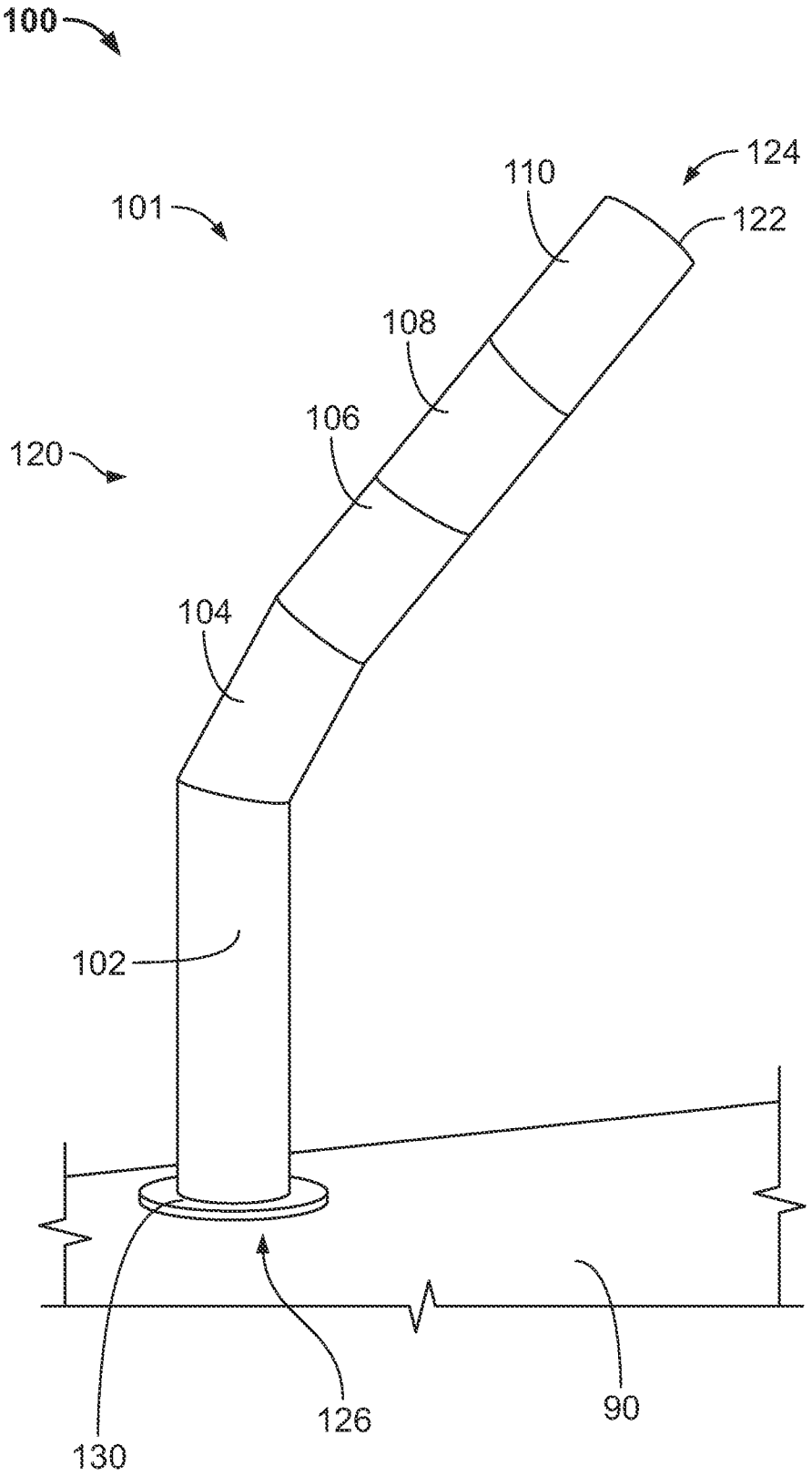
FIG. 3 is a side perspective view of the faucet of FIG. 1 in a rotating position, according to an exemplary embodiment.

FIGS. 1-3 illustrate an exemplary embodiment of a faucet assembly 100 shown movably coupled to a countertop 90 (e.g., via mounting fixture 130), and configured to discharge (e.g., emit, etc.) fluid 93 (e.g., water toward a sink for washing and the like) through an outlet 122. As shown, the faucet assembly 100 includes a faucet 101 having a base 102, which is movably or rotatably mounted to the countertop 90 and extends upwardly therefrom.

In various embodiments, the base 102 can move or rotate relative to the countertop 90. For example, the faucet assembly 100 can include one or more lifting mechanisms, as described in greater detail below, that facilitate moving the faucet 101 up or down relative to the countertop 90 between a first location (e.g., beneath the countertop 90, unexposed to a user, etc.) and a second location (e.g., above the countertop 90, exposed to a user, etc.). In this manner, the faucet 101 can be stored in the first location beneath the countertop 90 when not in use (e.g., when fluid 93 is not flowing from the outlet 122). When the faucet 101 is to be operated (e.g., to expel fluid 93 towards a sink), the faucet assembly 100 may be configured to move the faucet 101 in an upwards direction through the mounting fixture 130 such that the faucet 101 is exposed above the countertop 90 in the second location.

In various embodiments, the faucet 101 can include a spout 120. As shown throughout the figures, the spout 120 of the faucet 101 is articulable (e.g., reconfigurable, rearrangeable, moveable, etc.) from a first (e.g., moving) position to a second (e.g., rotating) position and towards a third position (e.g., use). FIG. 2 shows the spout 120 in an exemplary moving position. As shown, the outlet 122 of a first end 124 of the spout 120 is positioned in an upward direction away from the countertop 90 to which the base is movably coupled via the mounting fixture 130. For example, this positioning may occur as the faucet 101 transitions from the first location (e.g., beneath the countertop 90) towards the second location (e.g., above the countertop 90).

Figure 4:
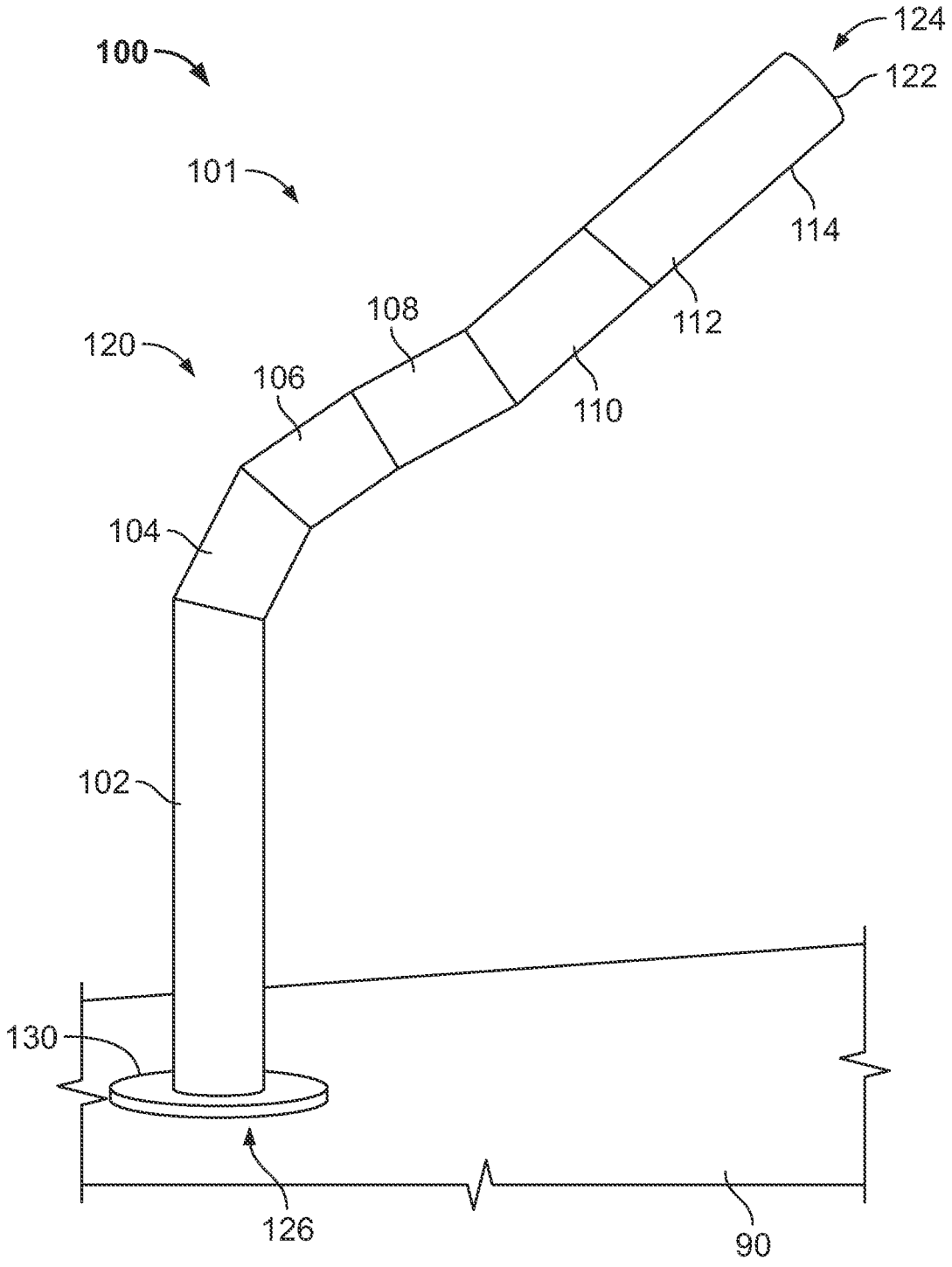
FIG. 4 is a side perspective view of a faucet in a rotating position, according to an exemplary embodiment.
Figure 5:
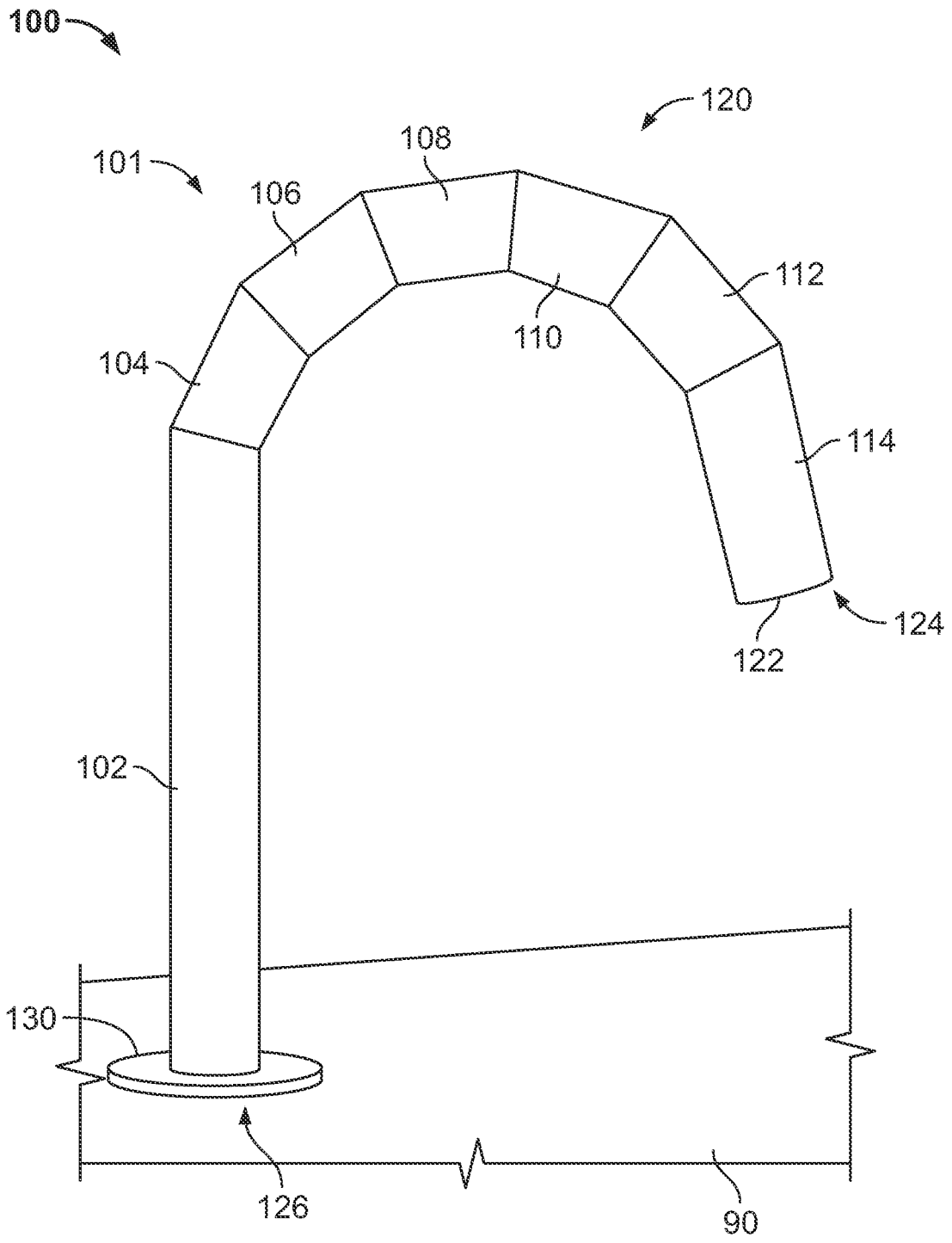
FIG. 5 is a side perspective view of the faucet of FIG. 4 in a use position, according to an exemplary embodiment.

FIGS. 3 and 4 show the spout 120 in various exemplary rotating positions with the spout 120 partially extending out over the countertop 90 (e.g., beyond the mounting fixture 130) with the outlet 122 moving towards a position to direct fluid 93 from the first end 124 of the spout 120 and towards an object or user (e.g., towards a sink mounted in the countertop 90). In the rotating position shown, a second end 126 of the spout 120 is exposed above the countertop 90 (e.g., such that the second end 126 engages with the mounting fixture 130), and the spout 120 is forming into a curved (e.g., arcuate) shape that, together with the base 102, can rotate to move into a use position (e.g., fluid 93 expelling from the outlet 122) and form an inverted J-shaped faucet 101, as shown in FIGS. 1 and 5.

As shown throughout the figures, the spout 120 includes one or more conduit sections that provide articulation of the spout 120 (relative to the base 102) between the first, second, and third positions. As shown in FIGS. 1-3, the faucet 101 includes four conduit sections (e.g., section 104, section 106, section 108, section 110). However, the faucet 101 can include any number of sections. By way of non-limiting examples, the faucet 101 shown in FIGS. 4 and 5 includes six sections (e.g., section 104, section 106, section 108, section 110, section 114), and the faucet 101 shown in FIGS. 6 and 7 includes two segments (e.g., section 104, section 106). Notably, the number of sections of the spout may be tailored, such as to the overall size of the faucet, the amount (e.g., distance, etc.) of articulation desired, as well as other suitable design parameters.

Figure 6:
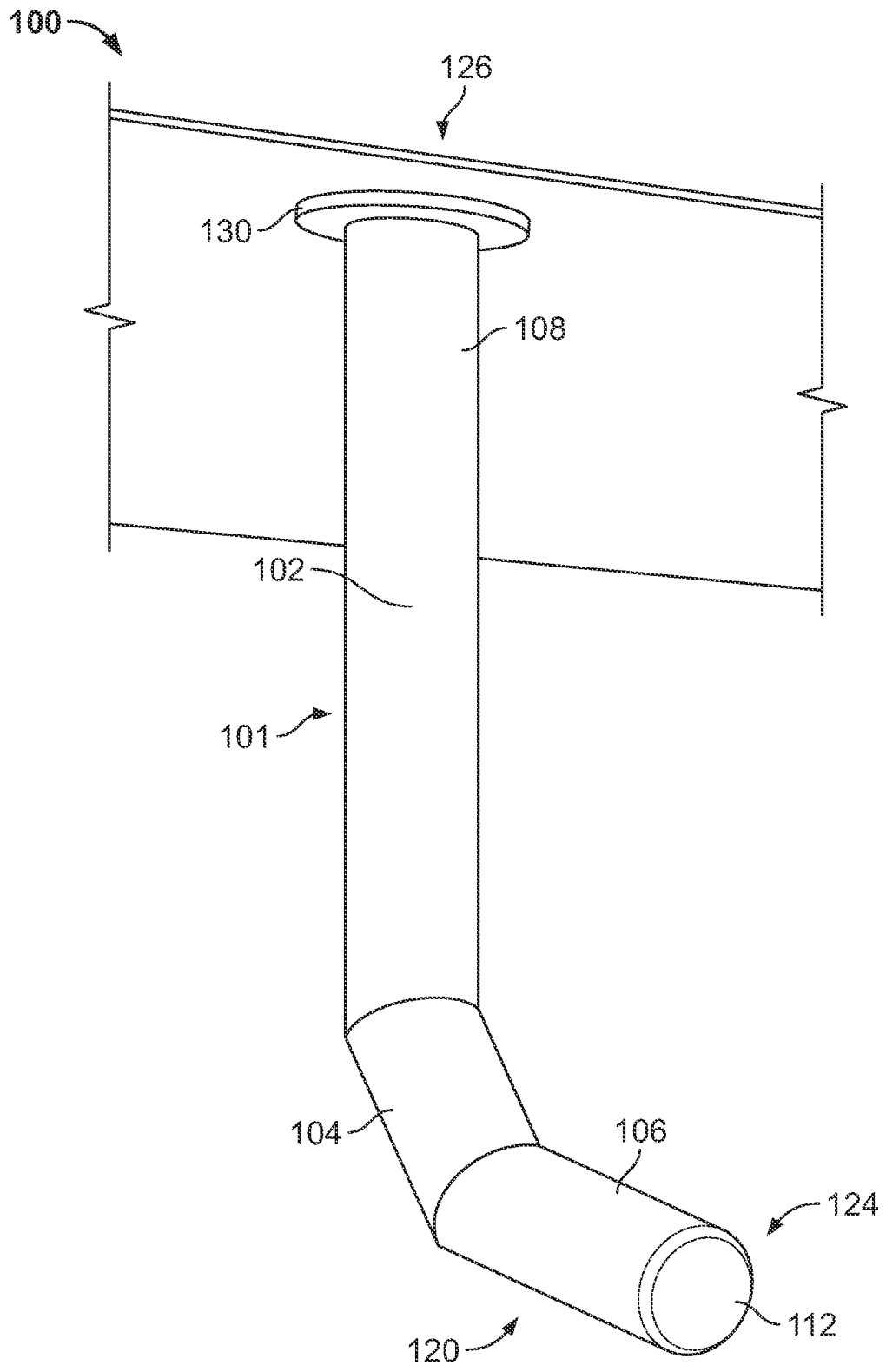
FIG. 6 is a front perspective view of a faucet in a use position, according to an exemplary embodiment.
Figure 7:
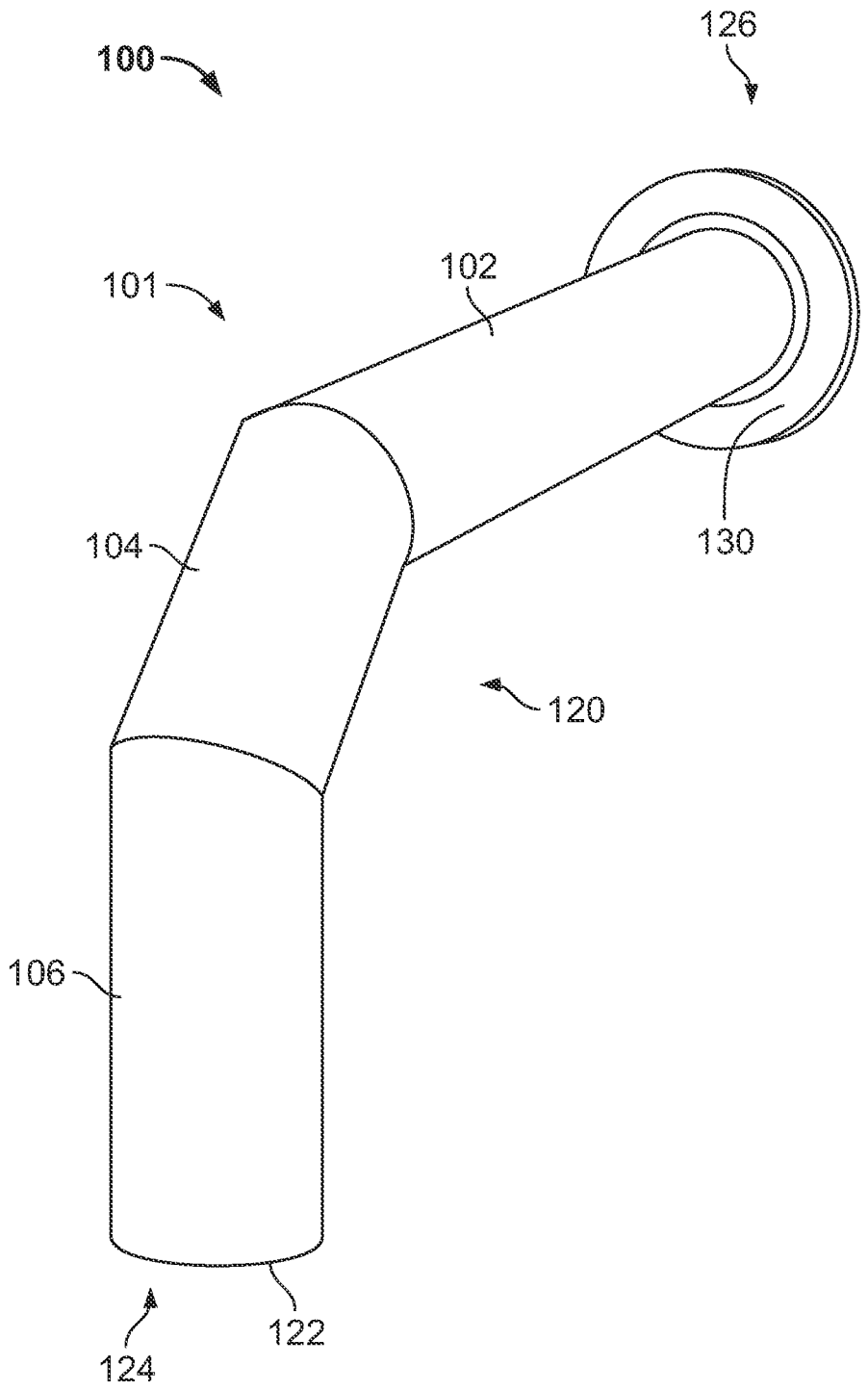
FIG. 7 is a front perspective view of a faucet in a use position, according to an exemplary embodiment.

While the positioning of the faucet 101 is generally discussed in relation to a countertop 90, such configuration is for exemplary illustration only. In various embodiments, the faucet 101 may be mounted to a ceiling, wall, or other portion of a kitchen, bathroom, or the like, as shown in FIGS. 6 and 7.

Figure 8:
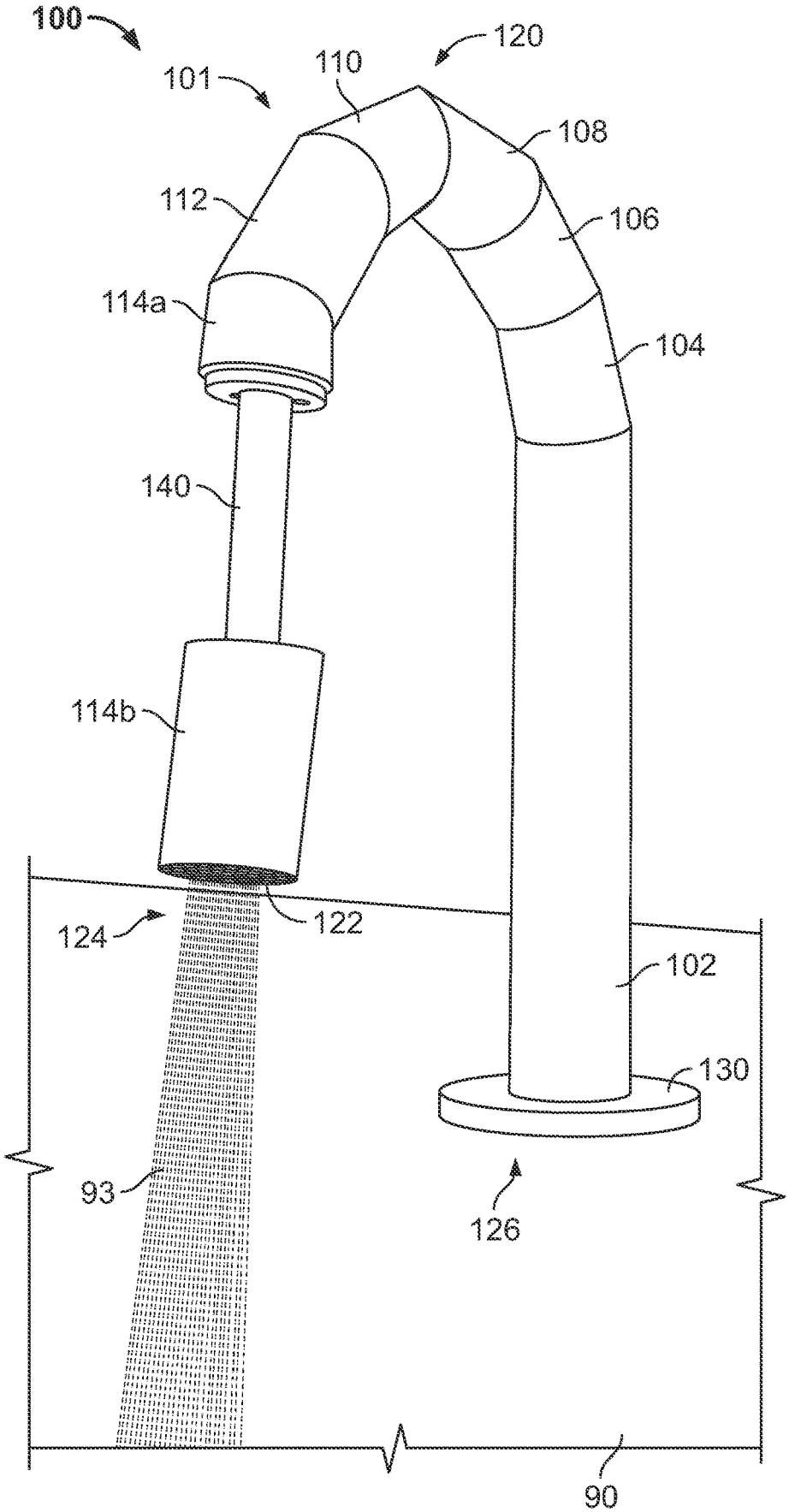
FIG. 8 is a front perspective view of a faucet in a use position, according to an exemplary embodiment.

Generally, the end section of the spout 120 includes the outlet 122. As shown in the exemplary embodiment in FIGS. 1-3, the end section (e.g., section 110) having the outlet 122 articulates (e.g., rotates) relative to the adjacent section (e.g., section 108), but the end section 110 is not detachable from the adjacent section 108. As shown in FIG. 8, the end section (e.g., 114) is detachable from the adjacent section (e.g., section 112) to reposition the outlet 122 (and end section into sections 114*a* and 114*b*) relative to the adjacent section 112.

The detachable end section 114 may be configured to articulate (or not articulate) relative to the adjacent section 112 depending on the application. The faucet 101 can have a fluid conduit (e.g., shown as flexible hose 140 in FIG. 8) to fluidly connect the outlet 122 to a fluid source (e.g., water supply), the base 102, a valve, and/or another element (e.g., component) of the faucet 101. The flexible hose 140, if provided, may route through an opening, cavity, or bore in the hollow base 102 and through the sections, as discussed in greater detail below.

Figure 9:
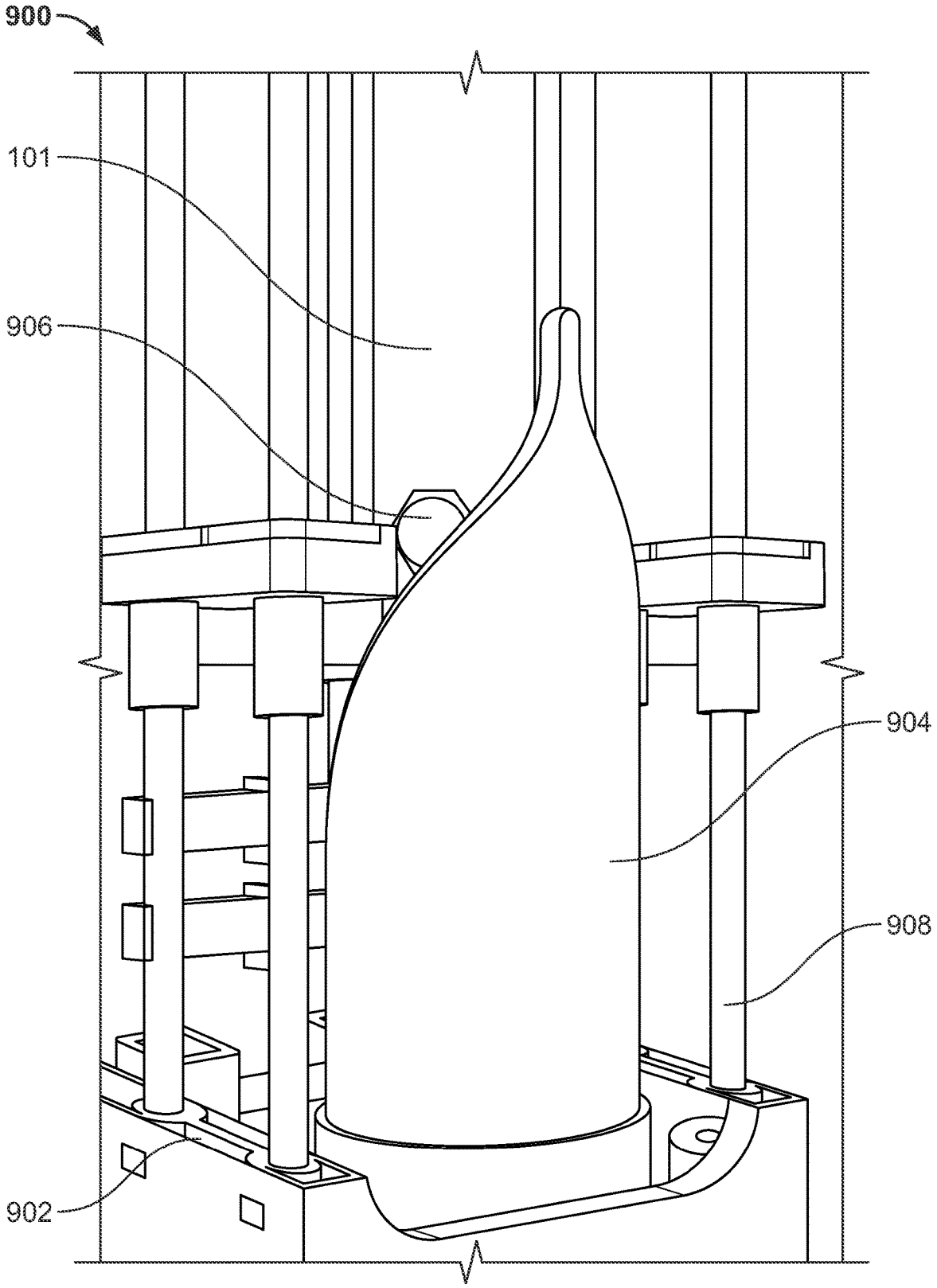
FIG. 9 is a perspective view of a lifting assembly of a faucet assembly, according to an exemplary embodiment.
Figure 10:
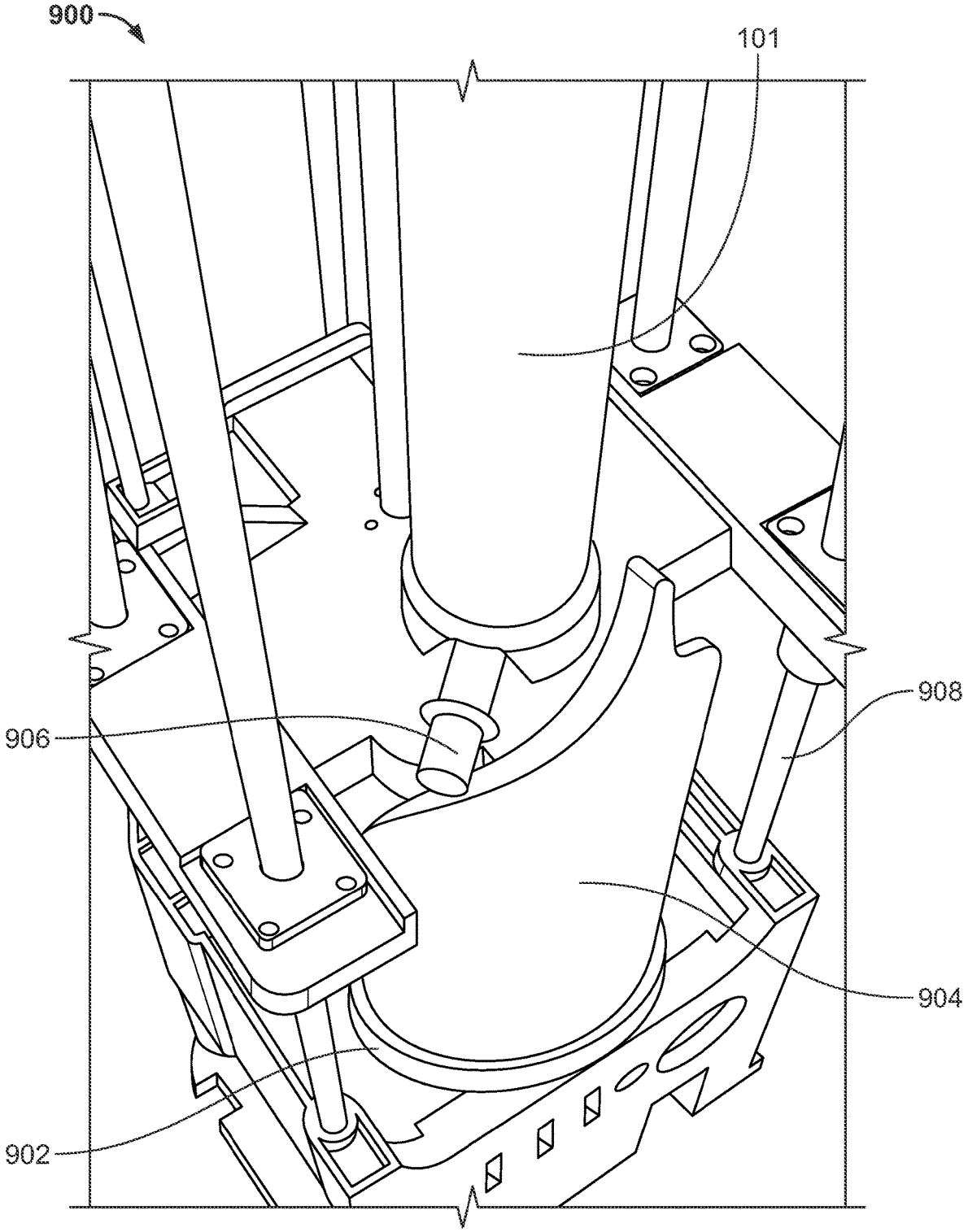
FIG. 10 is a perspective view of the lifting assembly of FIG. 9 in a first position, according to an exemplary embodiment.
Figure 11:
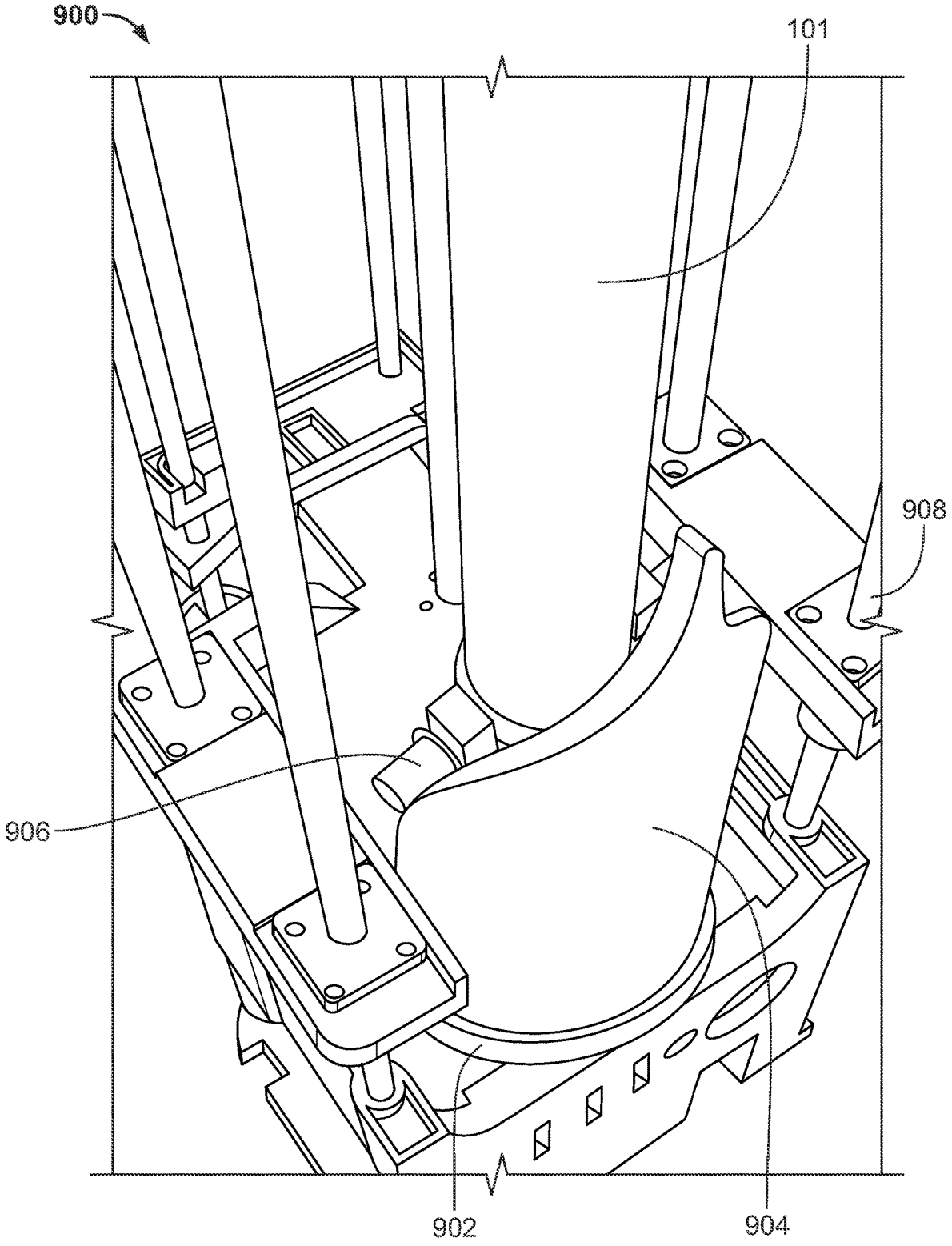
FIG. 11 is a perspective view of the lifting assembly of FIG. 9 in a second position, according to an exemplary embodiment.
Figure 12:
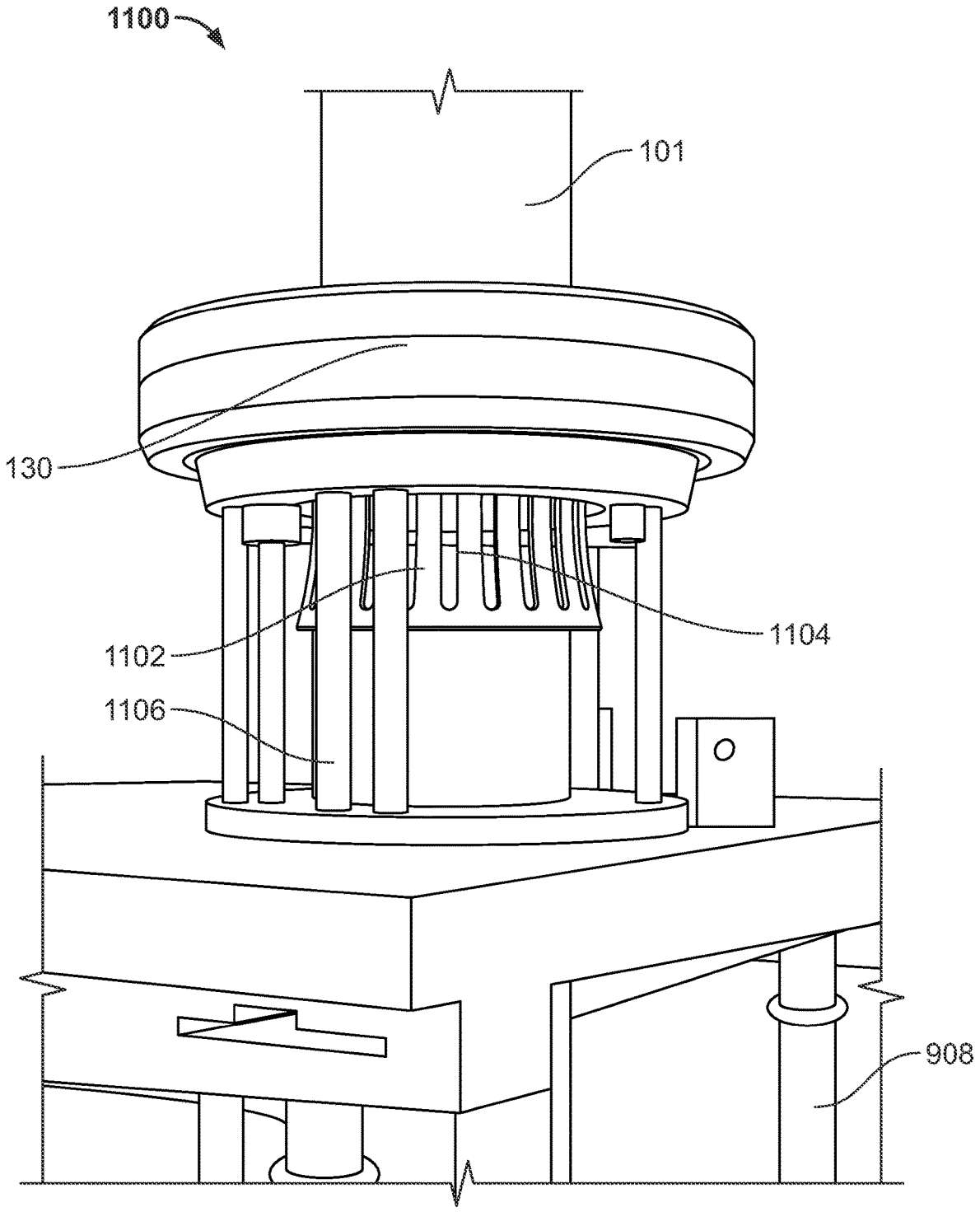
FIG. 12 is a perspective view of a cleaning assembly of a faucet assembly in a first position, according to an exemplary embodiment.
Figure 13:
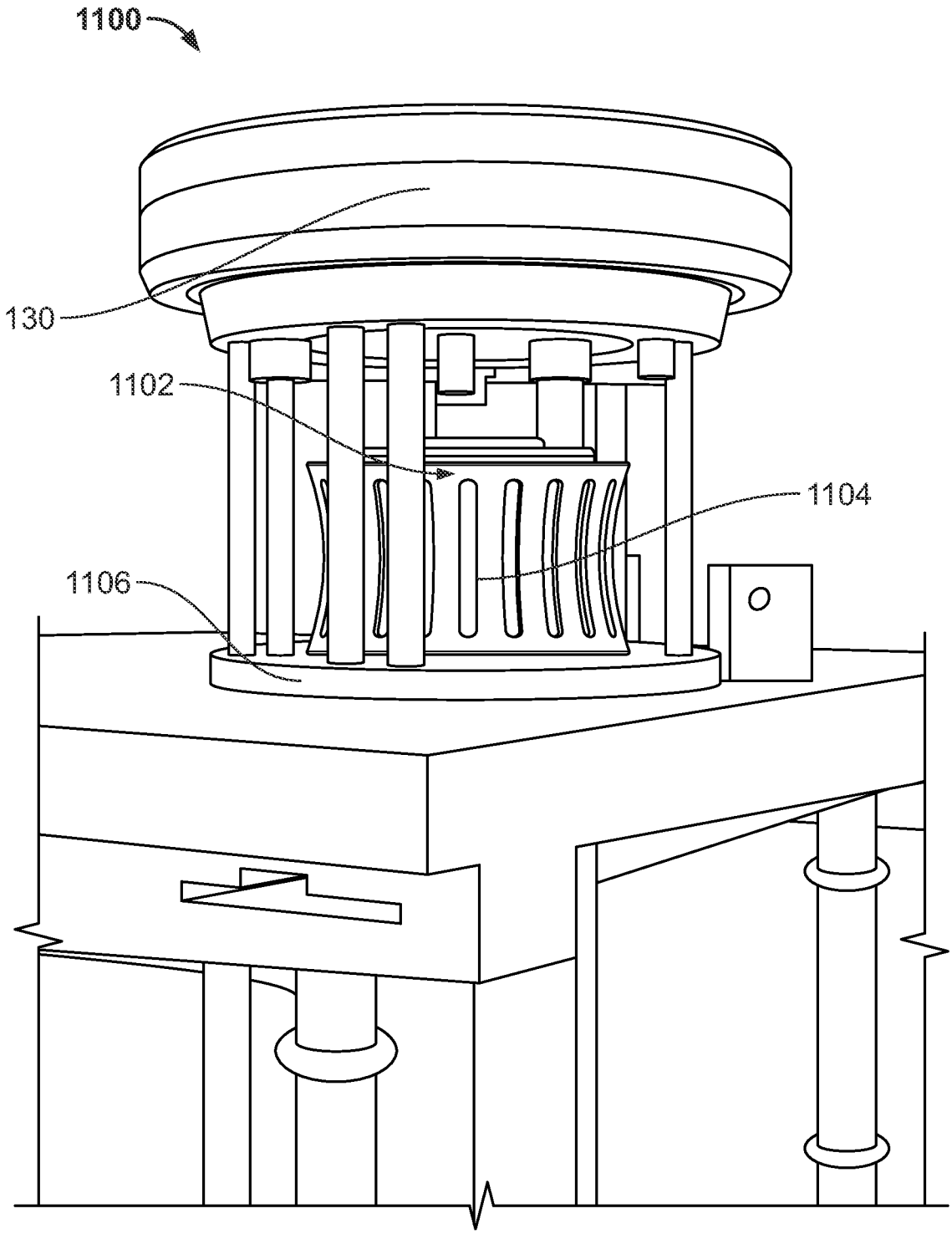
FIG. 13 is a perspective view of the cleaning assembly of FIG. 12 in a second position, according to an exemplary embodiment.

FIGS. 9-11 illustrate a portion of a lifting assembly 900 of the faucet assembly 100, according to an exemplary embodiment. As shown, the lifting assembly 900 can include a platform 902 configured to engage with a portion of the faucet 101, such as the second end 126 of the faucet 101 (e.g., an end portion of the base 102), to facilitate moving the faucet 101 up and down relative to the countertop 90 as described above. For example, the lifting assembly 900 can include one or more lifting structures 908 operably coupled to the platform 902 and another portion of the faucet assembly 100 (e.g., countertop 90, as shown in FIGS. 12 and 13) and configured to facilitate lifting the faucet 101 from the first location beneath the countertop 90 towards the second location above the countertop 90.

In some embodiments, the lifting assembly 900 may include one or more electric motors or pneumatic power sources operably coupled to the platform 902 or lifting structure 908 to provide power to the lifting assembly 900 to facilitate lifting the faucet 101 up or down. For example, in some embodiments, the lifting assembly 900 may include a stepper motor, a servo motor, a linear motor, a vane motor, a piston motor, a turbine motor, or the like. In some embodiments, the lifting assembly 900 may include various other electric or pneumatic actuators or power sources.

In various embodiments, the lifting assembly 900 may include one or more components to facilitate positioning of the faucet 101. For example, the lifting assembly 900 can include a guide 904 coupled to a portion of the lifting assembly 900 and a spout positioning attachment 906 movably coupled to a portion of the spout 120. As shown in FIGS. 10 and 11, the guide 904 and spout positioning attachment 906 can facilitate guiding the faucet 101 into a predetermined position as the faucet 101 moves from the second location above the countertop 90 to a first location beneath the countertop 90.

For example, the faucet 101 may be moved when in the use position in the second location above the countertop 90 (e.g., pushed by a user, rotated at the base, etc.). Such movement of the faucet 101 may change an initial positioning of one or more portions of the faucet 101, such as the spout 120 (e.g., from when the faucet 101 is first moved into the second location). To maintain a centralized position of the faucet 101 (e.g., such that the outlet 122 is positioned in a same approximate location upon movement of the faucet 101 from the first location to the second location), the spout positioning attachment 906 engages with a portion of the guide 904 when descending from the second location to the first location (as shown in FIG. 10). As the faucet 101 continues descending into the first location beneath the countertop 90, the spout positioning attachment 906 is guided along the guide 904 such that the faucet 101 rotates in reference to the mounting fixture 130 towards a predetermined location (e.g., until reaching an end portion of the guide 904 as shown in FIG. 11). In this manner, the faucet 101 can move and rotate into the same position (e.g., outlet 122 position, angle, etc.) each time the faucet 101 is moved from the first location to the second location.

In some embodiments, the lifting assembly 900 can include one or more sensors to detect movement or location of the faucet 101 to facilitate detecting movement of the faucet 101 in the second location (e.g., above a countertop 90). For example, the lifting assembly 900 can include a proximity sensor, rotary motion sensors, Hall Effect sensors, Eddy-current sensors, potentiometers, ultrasonic sensors, or other similar positioning or proximity sensors. While the lifting assembly 900 shown in the exemplary embodiment in FIGS. 9-11 includes a platform 902 positioned at the second end 126 of the faucet 101 and four structures 906 surrounding the faucet 101, other embodiments may include various other lifting components including, but not limited to pulleys, linkages, cranks, or other appropriate lifting mechanisms that facilitate moving the faucet 101 between the first location and the second location.

FIGS. 12 through 16 illustrate an exemplary embodiment of a cleaning assembly 1100 of the faucet assembly 100. As shown, the faucet assembly 100 includes one or more cleaning attachments 1102. For example, the cleaning attachment 1102 can movably couple to a portion of the faucet 101, as shown in FIGS. 12 and 13. In various embodiments, the cleaning attachment 1102 can couple to a portion of the faucet 101 at a location beneath the countertop 90. The cleaning attachment 1102 can couple to the faucet 101 such that the cleaning attachment 1102 moves between a first position (e.g., an upper position, as shown in FIG. 12) and a second position (e.g., a lower position, as shown in FIG. 13).

In various embodiments, the cleaning attachment 1102 includes one or more projections, shown as cleaning projections 1104 to facilitate removing debris (e.g., fluid, dirt, residue, etc.) from the spout 120 or other portions of the faucet assembly 100. For example, the cleaning projections 1104 may be configured to engage with a portion of the spout 120 as the spout 120 moves between the first location and the second location. Such engagement may facilitate removing debris and flushing out fluid from the faucet 101.

Figure 14:
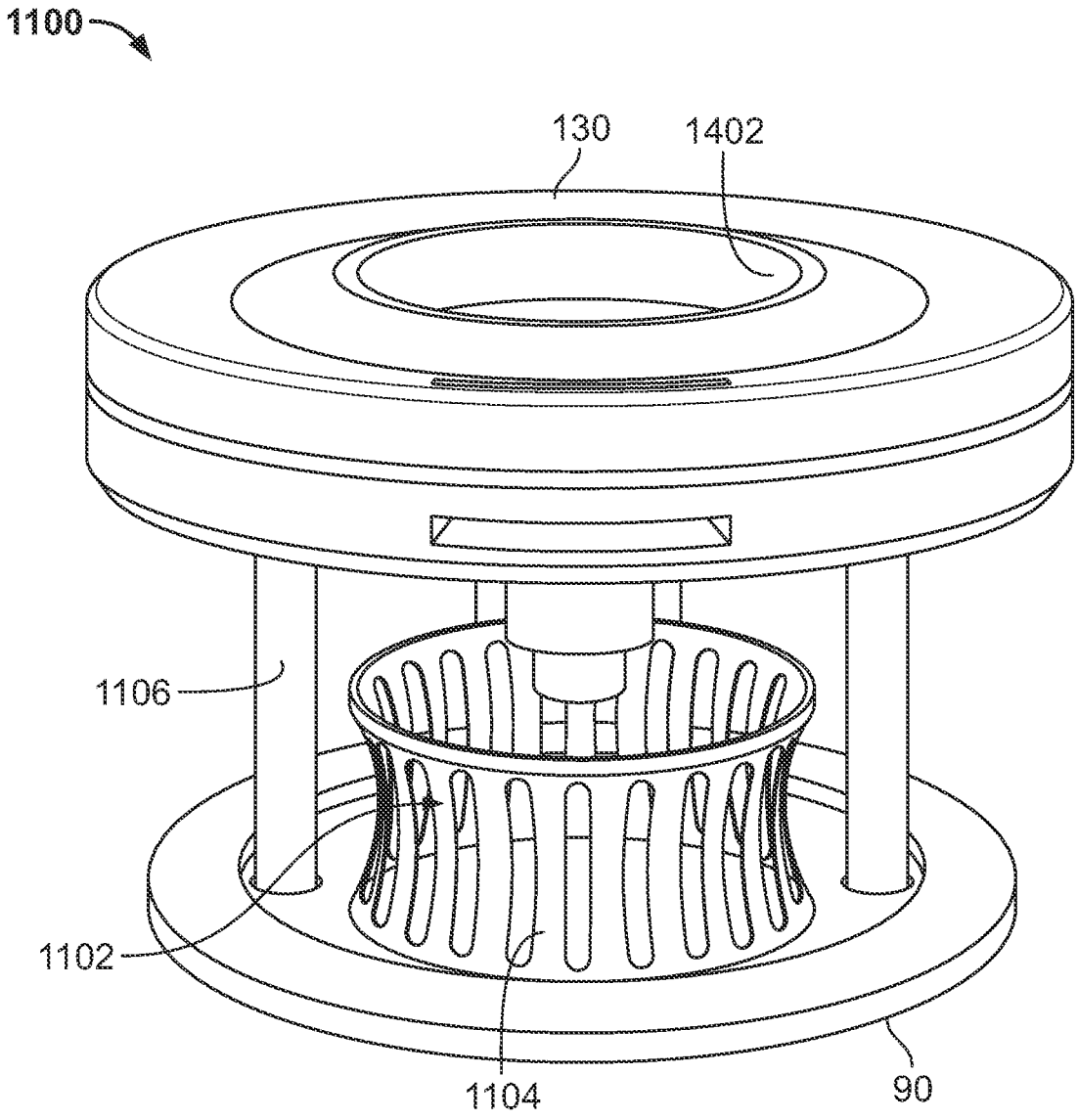
FIG. 14 is a perspective view of a portion of the cleaning assembly of FIG. 12, according to an exemplary embodiment.
Figure 15:
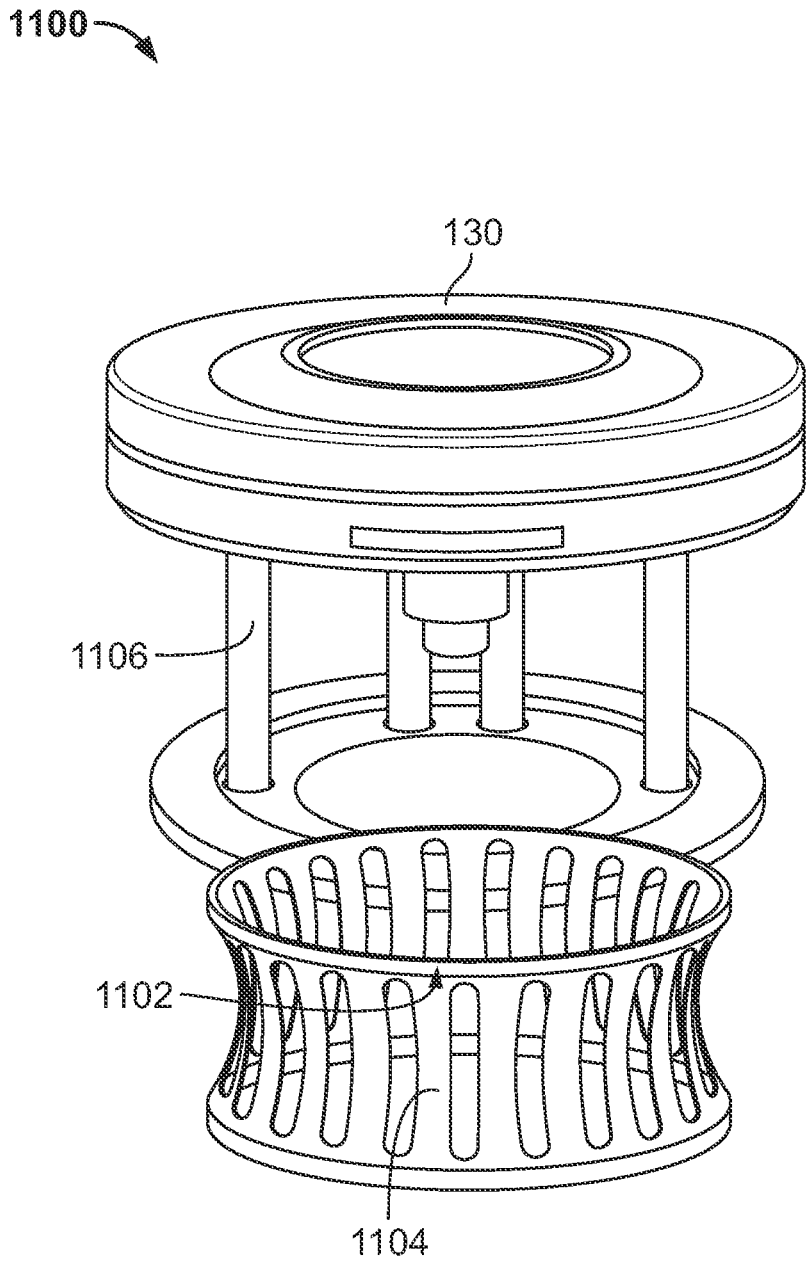
FIG. 15 is a perspective view of a portion of the cleaning assembly of FIG. 12, according to an exemplary embodiment.

In various embodiments, the cleaning attachment 1102 is disposed beneath another portion of the faucet assembly 100, such as the mounting fixture 130, as shown in FIGS. 12-14. In various embodiments, the mounting fixture 130 includes one or more portions movably coupled to the countertop 90, as shown in FIG. 14, and among others. For example, the cleaning assembly 1100 may include one or more stands 1106 to facilitate lifting the mounting fixture 130 in an upward direction (e.g., away from the countertop 90) to expose the cleaning attachment 1102 to a user of the faucet 101.

The cleaning attachment 1102 of the cleaning assembly 1100 may be removed in various manners. For example, the cleaning attachment 1102 may automatically be dispensed (e.g., ejected from the second end 126 of the spout 120 through the opening formed by stands 1106) from the cleaning assembly 1100 after a certain period of time, number of cycles, etc. In such example, the cleaning assembly 1100 may include one or more sensors, actuators, or motors to facilitate automatically dispensing the cleaning attachment 1102. In another example, the cleaning attachment 1102 may be manually removed by a user at the user's discretion.

Figure 16:
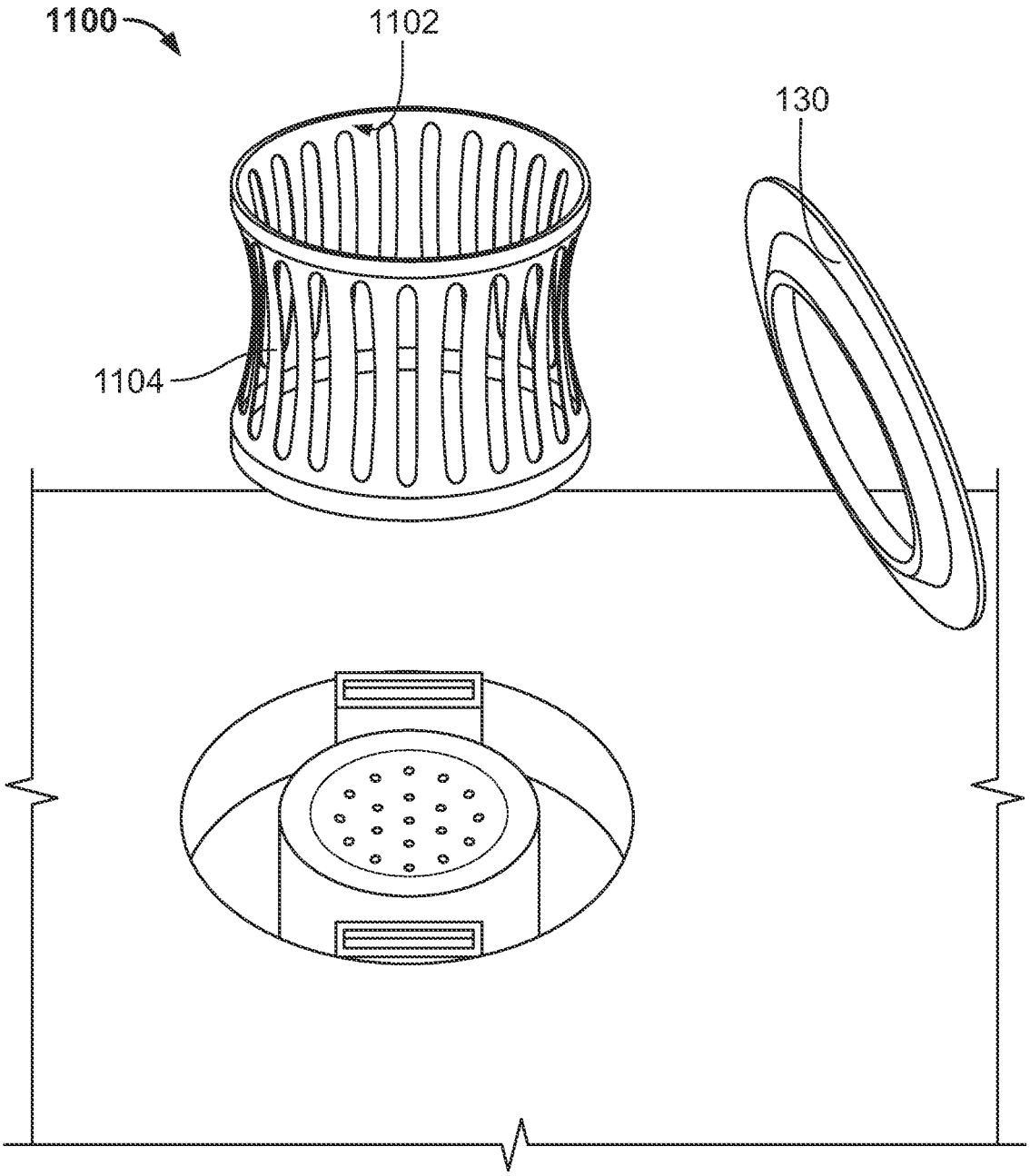
FIG. 16 is a perspective view of a portion of the cleaning assembly of FIG. 12, according to an exemplary embodiment.

In various embodiments, the mounting fixture 130 may facilitate blocking the outlet 122 of the faucet 101 from exposure to the external environment by covering a portion of the outlet 122 (e.g., when the faucet 101 is not in use or is beneath the countertop 90). The mounting fixture 130 may include one or more components to facilitate covering the faucet 101. For example, the mounting fixture 130 may include one or more shutters 1402 that project in and out from an internal portion of the mounting fixture 130 to cover and uncover the faucet 101, as shown in FIG. 14. In such an example, the faucet assembly 100 may include one or more sensors, actuators, or motors to facilitate automatically opening and closing the shutters 1402. In another example, the mounting fixture 130 may removably couple to the countertop 90 such that a user may manually remove the mounting fixture 130 from the countertop 90, as shown in FIG. 16. For example, the cleaning assembly 1100 may include a magnetic cover to overlap one or more portions of the outlet 122 or cleaning assembly 1100 when the faucet 101 is not in use.

Figure 17:
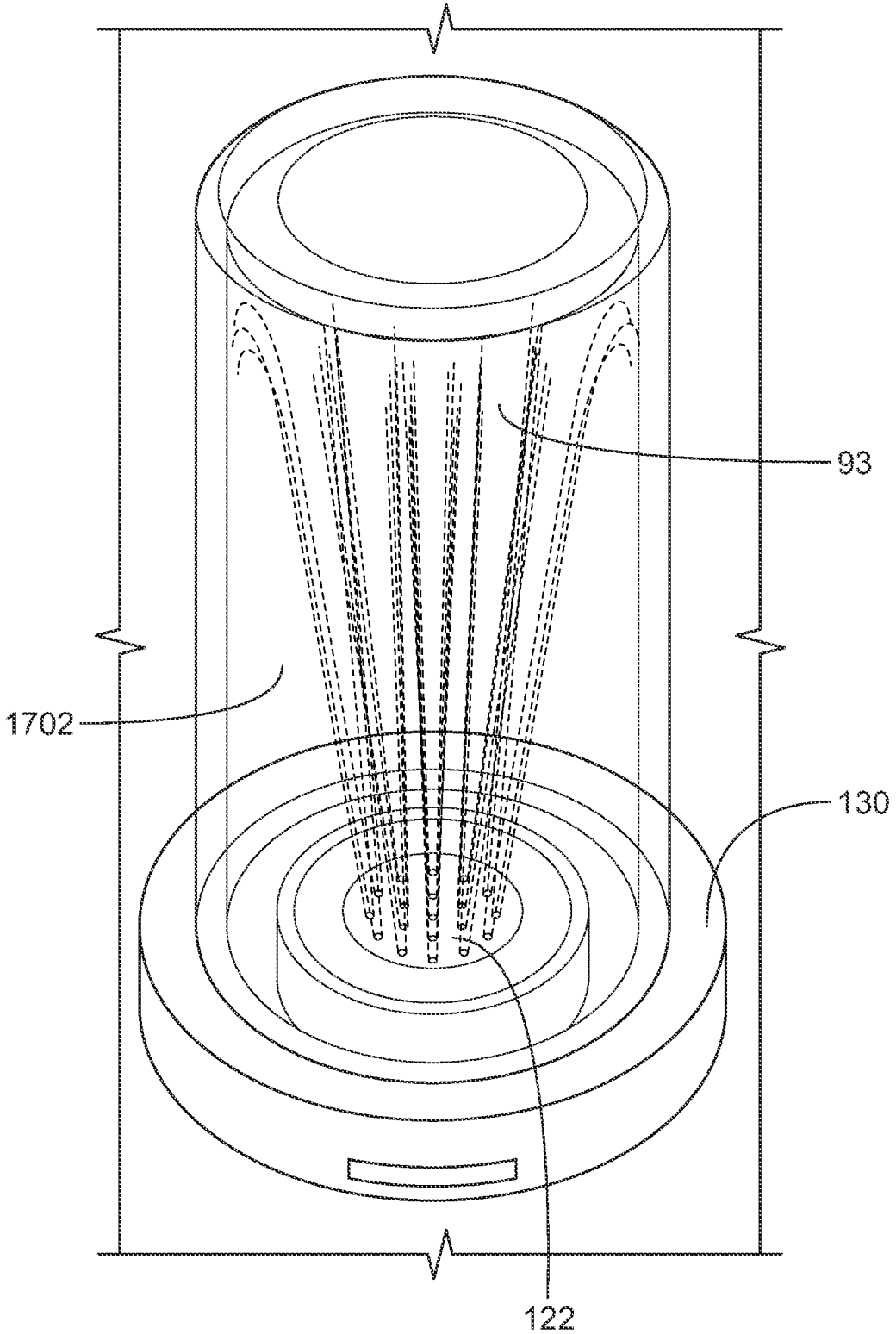
FIG. 17 is a perspective view of a portion of the cleaning assembly of FIG. 12, according to an exemplary embodiment.

FIG. 17 shows a portion of the cleaning assembly 1100, according to an exemplary embodiment. As shown in FIG. 17, the faucet 101 may be configured to move such that the outlet 122 of the second end 126 of the spout 120 is disposed at the mounting fixture 130 (e.g., coplanar with the countertop 90 such that no portion of the sections are exposed above countertop 90). Such configuration allows for the faucet 101 to perform various cleaning tasks. By way of example, a user may place dishware 1702, such as a cup, mug, bowl, or the like, over a portion of the outlet 122. The user may then actuate flow of fluid 93 from the faucet 101 to be dispersed from the outlet 122, while the dishware 1702 is still placed over the outlet 122. Accordingly, fluid 93 may spray in an upward direction (e.g., toward the dishware 1702, opposite the countertop 90, etc.) to facilitate cleaning the dishware 1702. In various embodiments, the cleaning assembly 1100 may include one or more drainage channels formed within a portion of the faucet assembly 100 (e.g., within the mounting fixture 130) to facilitate draining excess fluid or debris from the dishware 1702 towards a drain below the countertop 90 or towards a sink mounted within the countertop 90.

Figure 18:
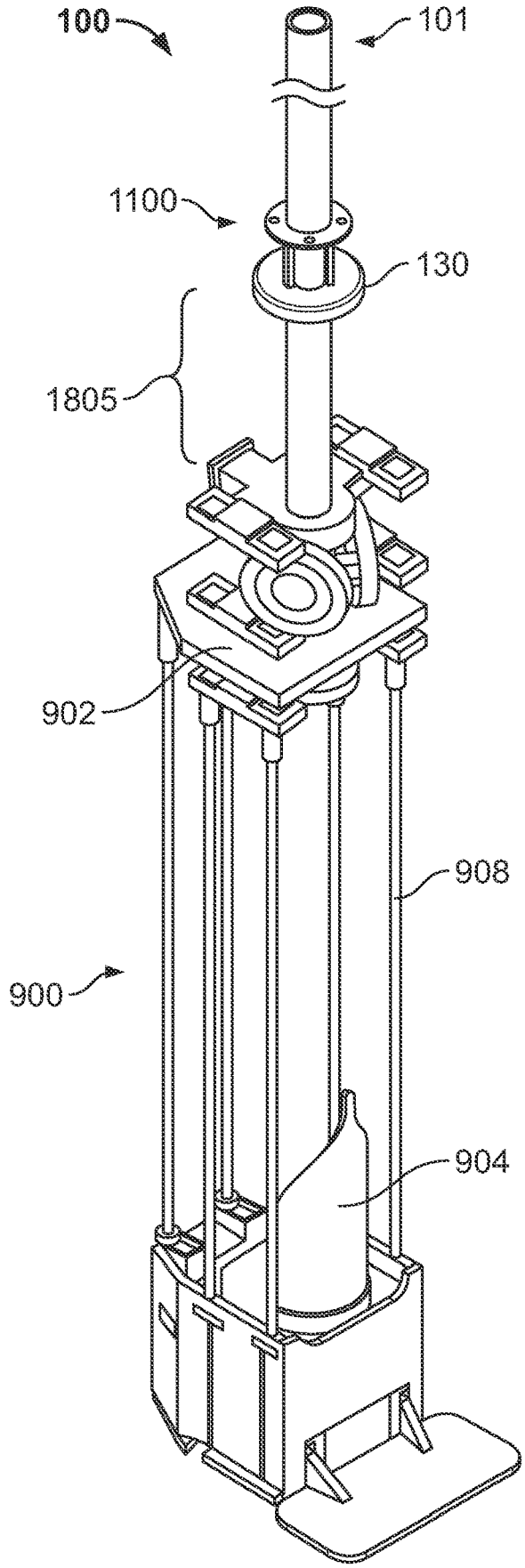
FIG. 18 is a perspective view of a faucet assembly, according to an exemplary embodiment.

FIG. 18 shows a perspective view of the faucet assembly 100, according to an exemplary embodiment. FIG. 18 shows the faucet assembly 100 in isolation (i.e., without the countertop 90), such that the configuration of the faucet assembly 100 can be shown in greater detail. In various embodiments, the countertop 90 may be generally disposed within area 1805. As shown in FIG. 18, the lifting assembly 900, the cleaning assembly 1100, and the faucet 101 may all be operably coupled to one another to form the faucet assembly 100. While the exemplary embodiment shown in FIG. 18 includes the lifting assembly 900, the cleaning assembly 1100, and the faucet 101, it should be appreciated that the faucet assembly 100 may include more or less components.

Figure 19:
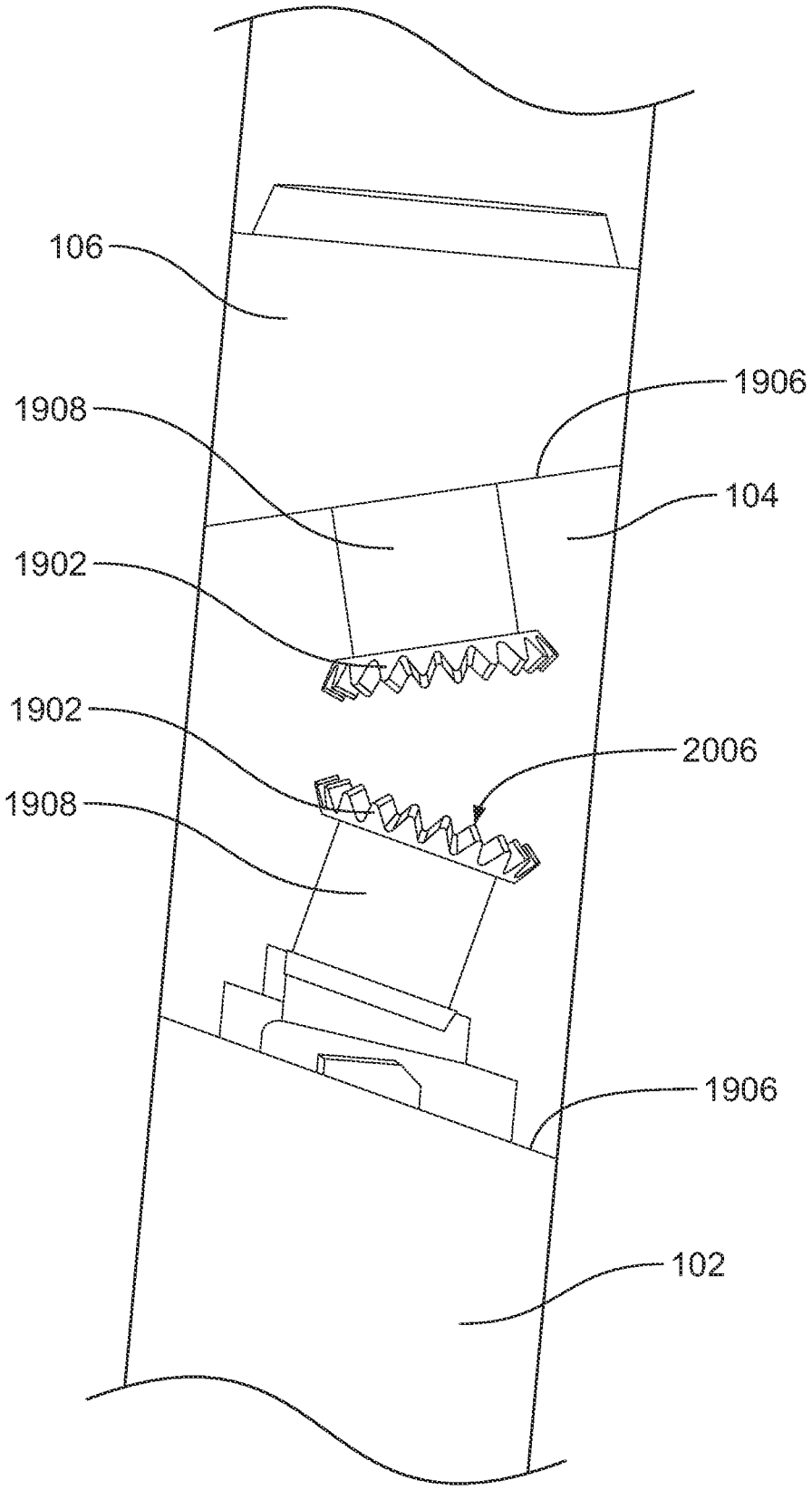
FIG. 19 is a side perspective view of an interior portion of a faucet, according to an exemplary embodiment.
Figure 20:
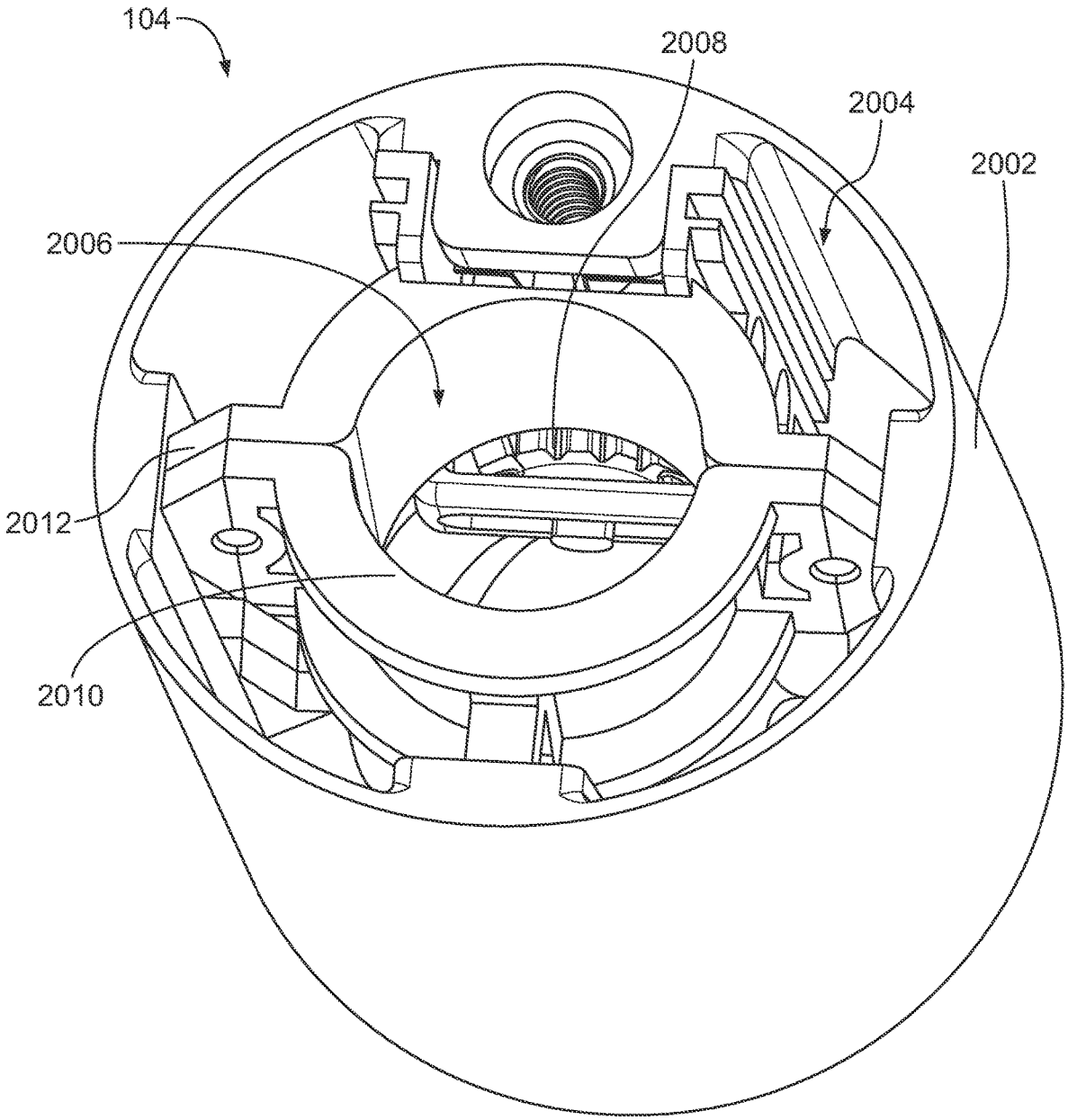
FIG. 20 is a perspective view of an interior portion of a faucet, according to an exemplary embodiment.

FIGS. 19-23 illustrate an exemplary embodiment of sections of the faucet 101. As shown in FIG. 20, the section (e.g., section 104) includes a hollow body 2002. Each body 2002 defines a portion of an exterior (e.g., an exterior shape) of the spout 120 and the faucet 101. As shown in FIGS. 1 and 2, the bodies of the sections define the configuration (e.g., shape, aesthetic finish, etc.) of the spout 120. The body of each section can complement the bodies of the other section or the base 102. As shown in FIGS. 19-24, the hollow body 2002 can have a substantially cylindrical shape or extruded elliptical shape (e.g., a cylinder having an elliptical cross-section rather than a circular cross-section) with a bore 2004 that receives various inner components therein. For example, the body 2002 can include one or more gears, as will be discussed below. In various embodiments, the hollow body 2002 can have various other shapes including, but not limited to, cylindrical, rectangular, triangular, or other shapes.

As shown in FIGS. 19-23, each spout 120 may include at least one driving section (e.g., shown as drive section 104 throughout FIGS. 19-23) and at least two slave sections (e.g., shown as slave sections 102 and 106 throughout FIGS. 19-23). The fixed base section at the base of the faucet (e.g., section 102) may be considered a slave section in this regard because it is driven from the frame of reference of the adjacent driving section (e.g., section 104). As will be described, the driving section 104 is configured to receive power (e.g., electric power, pneumatic power, etc.) from one or more power sources and is configured to cause each slave section 102 and 106 to rotate relative to the driving section 104. While only one driving section is shown in FIGS. 19-23, it is important to note that various embodiments may include any number of driving sections in various configurations. For example, an embodiment having five total sections, as shown in FIGS. 1 and 3, may include 2 driving sections (e.g., section 104 and section 108). An embodiment having seven total sections, as shown in FIGS. 4 and 5, may include 3 driving sections (e.g., section 104, section 108, and section 112). In general, the faucet may include any number of total sections and every other section may be a driving section. For example, an embodiment having three total sections may include one driving section in the middle with a slave section on each side. An embodiment having five total sections may have two driving sections (e.g., the second and fourth sections), with the remaining sections being slave sections.

FIG. 19 illustrates a portion of an interior of a section (e.g., interior components of the slave section 102 and the slave section 106 in connection with the transparent drive section 104) of the faucet 101. The slave sections 102 and 106 each include an angled gear 1902 circumferentially surrounding an opening 2006 for receiving a portion of a hose (e.g., flexible hose coupled to a water supply). In various other embodiments, the gears may not surround the opening 2006. In various embodiments, each angled gear 1902 integrally couples to an interior portion of the corresponding slave section (e.g., a first angled gear 1902 couples to the slave section 102 and a second angled gear 1902 couples to the slave section 106, as shown in FIG. 19). For example, each angled gear 1902 may couple to its corresponding slave section such that the section rotates upon rotation of the angled gear 1902. As shown in FIG. 19, each angled gear 1902 may project from a portion of its corresponding section into an interior portion of the drive section 104 to engage with a driver gear within the drive section, as discussed in greater detail below. For example, each angled gear 1902 may couple to one or more gear shafts 1908 to extend from a portion of its corresponding slave section and engage with a bearing component, as discussed below.

FIG. 20 illustrates a perspective view of a drive section of the faucet 101 (e.g., drive section 104 disposed between slave sections 102 and 106 shown in FIG. 19). As shown in FIG. 20, the drive section 104 may include two bearing components 2010 to receive a portion of another section (e.g., the angled gear 1902 of a slave section, as shown in FIG. 19). For example, the bearing components 2010 may couple to an internal portion of a section body, shown as body 2002. In various embodiments, the body 2002 is a hollow body that includes a bore 2004 that receives various interior components of the sections including the angled gears 1902, the bearing components 2010, or a hose disposed through opening 2006.

As shown in FIG. 20, the bearing components 2010 may circumferentially surround the longitudinal opening 2006 extending through the bearing components 2010 to house and/or route other elements/components of the faucet 101. In various embodiments, the bearing components 2010 include one or more flanges 2012 extending radially outward around at least part of the section 104 to facilitate coupling the bearing components 2010 and various internal features disposed within the bearing components 2010 (e.g., flexible hose, gear shaft 1908, etc.) to the section 104. When assembled, the gear shafts 1908 of a slave gear may extend through the bearing components 2010 of the adjacent drive sections such that the angled gears 1902 engage the driver gears within the adjacent drive sections. The gear shafts 1908 may rotate within the bearing components 2010 as the adjacent segments rotate relative to each other.

Figure 21:
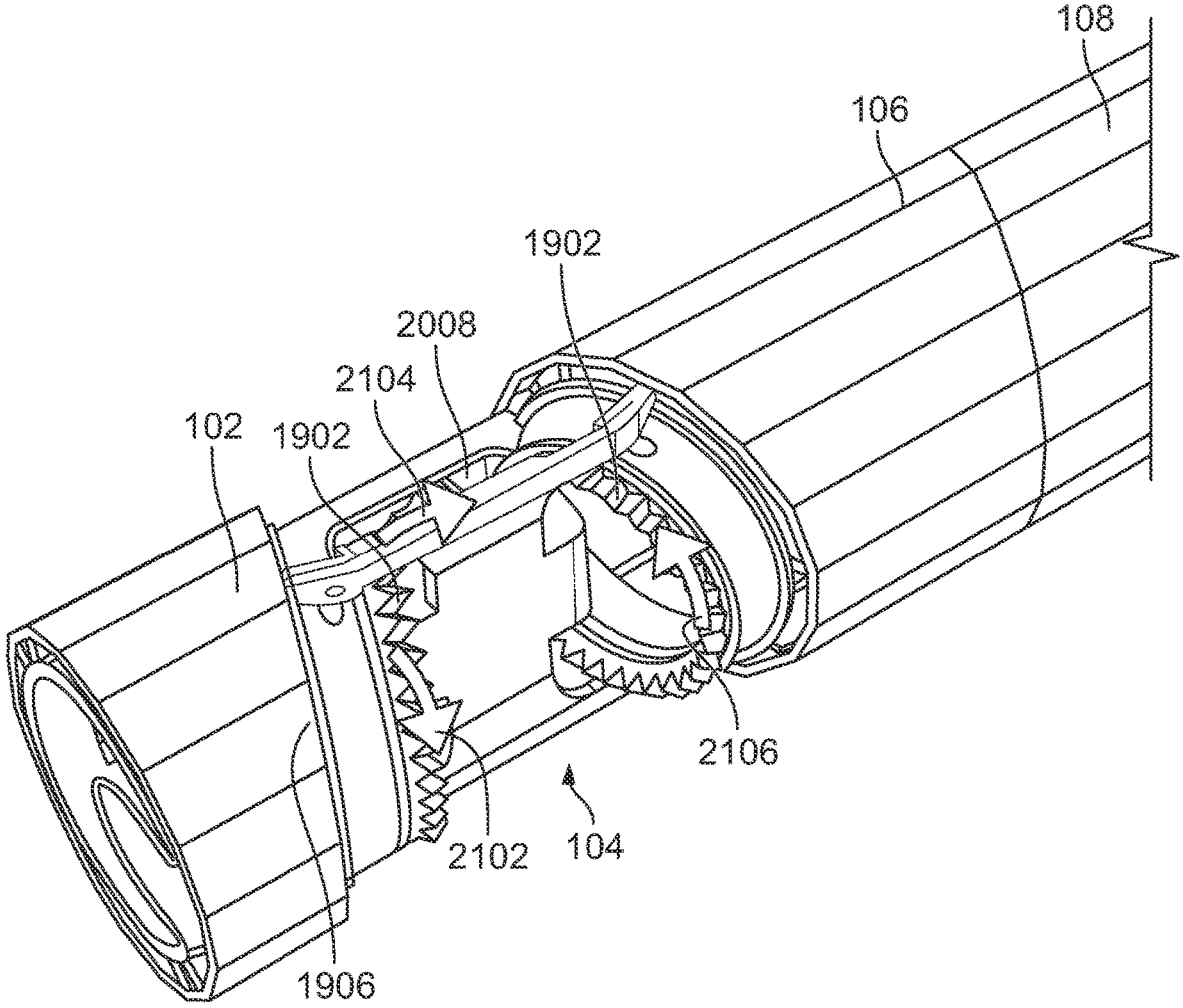
FIG. 21 is a front perspective view of an interior portion of a faucet, according to an exemplary embodiment.

As shown throughout FIGS. 20-23, the drive section 104 may include a drive gear 2008. In various embodiments, the drive gear 2008 is disposed along one side portion of the interior of the body 2002. In various embodiments, the drive gear 2008 extends at least partially between each angled gear 1902. In this configuration, the teeth of the drive gear 2008 engage with the teeth of a first angled gear 1902 at one portion of the drive gear 2008 and the teeth of a second angled gear 1902 engage with the teeth of the drive gear 2008 at another portion of the drive gear 2008, as can be seen in FIG. 21. In this manner, rotation of the drive gear 2008 causes rotation of each slave gear 1902, which causes rotation of each slave section (e.g., sections 102 and 106) relative to the frame of reference of the drive gear. If a given slave section is held in a fixed position from the frame of reference of an external observer (e.g., section 102 at the base of the faucet), the relative rotation between the slave section and the drive section causes the drive section to rotate from the frame of reference of the external observer (e.g., a user). In various embodiments, the drive gear 2008 is different in size in comparison to the angled gears 1902.

By way of example, the drive gear 2008 may be sized such that one half revolution (e.g. 180° revolution) of the drive gear 2008 may cause a full revolution (e.g., 360° revolution) of each angled gear 1902. In various embodiments, each angled gear 1902 may be the same size or shape. In various other embodiments, the angled gears 1902 may differ in size or shape.

In various embodiments, each angled gear 1902 may be disposed at an angle relative to the longitudinal axis (represented by center axis 2310 in FIG. 23) of the faucet 101 in a moving position (e.g., extending from the first end 124 to the second end 126). By way of example, each angled gear 1902 may be disposed at an angle of 20 degrees relative to the longitudinal axis (represented by the angle between center axis 2310 and angled gear axis 2306 in FIG. 23). In this manner, the teeth of the drive gear 2008 may produce a greater drive force on the teeth of each angled gear 1902 of each slave section (e.g., compared to the angled gear 1902 being disposed at a smaller angle relative to the center longitudinal axis). In various other examples, the angled gears 1902 may be disposed at an angle greater than or less than 20 degrees. In various embodiments, the angled gears 1902 may be disposed at equal and opposite angles relative to the longitudinal axis of the faucet 101, as shown in FIGS. 19, 21, and 23.

In various embodiments, an angled gear 1902 may integrally couple to the slave section 102 such that rotation of the angled gear 1902 causes rotation of the slave section. By way of example, rotation of the angled gear 1902 may cause rotation of the slave section 102 relative to another section of the faucet 101. In various embodiments, an angled gear 1902 may integrally couple to the slave section 106 such that rotation of the angled gear 1902 causes rotation of the slave section 106. By way of example, rotation of the angled gear 1902 may cause rotation of the slave section 106 relative to the drive section 104. In various embodiments, the drive gear 2008 may rotatably couple to the drive section 104 such that the drive gear 2008 may freely rotate even if the drive section 104 is fixed in place.

Figure 23:
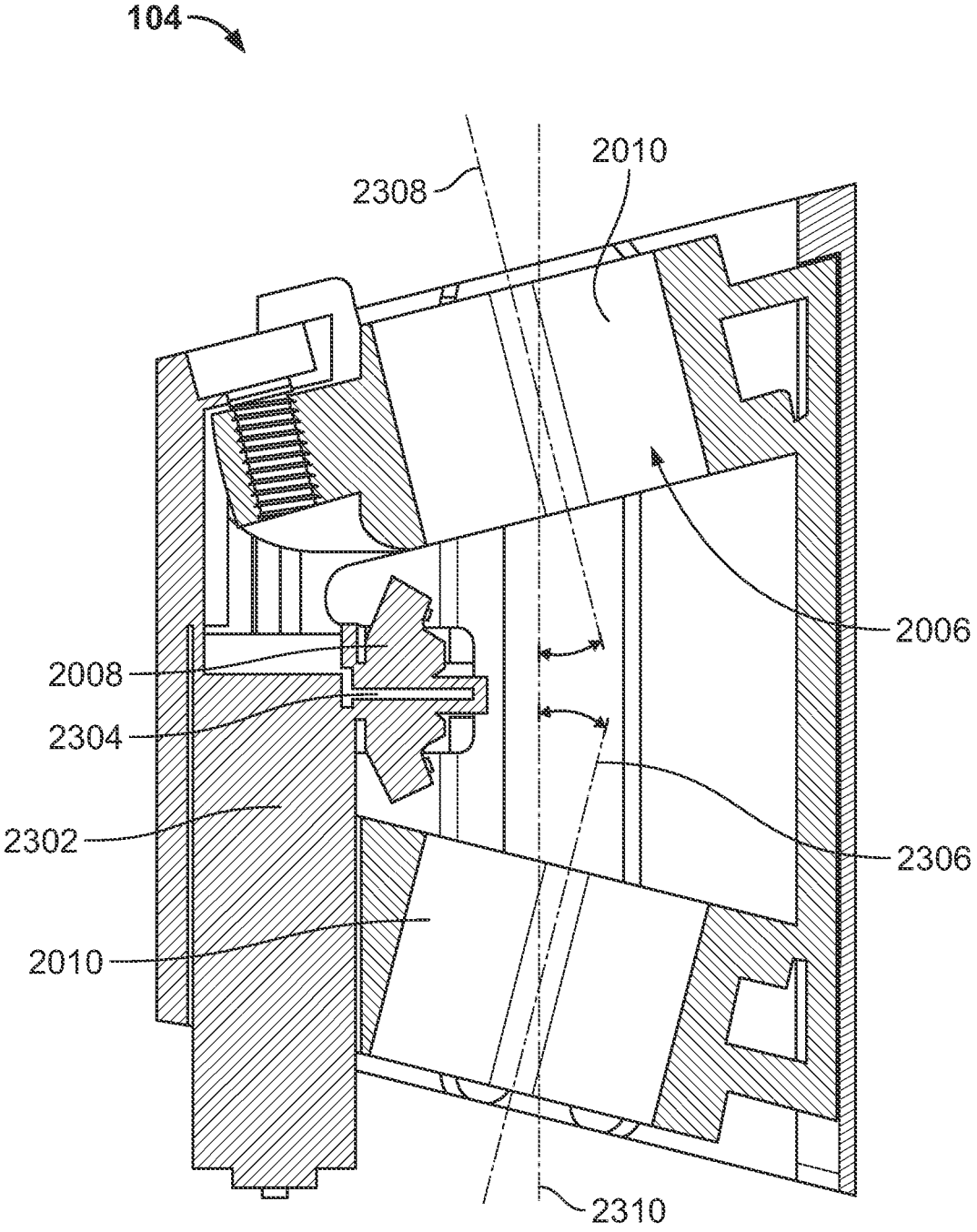
FIG. 23 is a side cross-sectional view of an interior portion of a faucet, according to an exemplary embodiment.

In various embodiments, rotation of the drive gear 2008 is caused by a motor (e.g., shown as motor box 2302 in FIG. 23). For example, the motor can operably couple to the drive gear 2008 (e.g., via one or more shafts, axles, bearings, or the like) to cause rotation of the drive gear 2008. In various embodiments, the motor box 2302 and the coupling of the motor box 2302 with the drive gear 2008 (e.g., axle 2304 shown in FIG. 23) may be rigidly coupled with the drive section 104 such that the drive gear 2008 rotates about axle 2304 relative to the section 106. The rotation of the drive gear 2008 about the axle 2304 can then cause each angled gear 1902 to rotate (e.g., in equal and opposite directions). By way of example, the motor can cause the drive gear 2008 to rotate in clockwise direction (shown by arrow 2104 in FIG. 21). As the drive gear 2008 rotates in the direction as shown, each angled gear 1902 rotates about a center of the faucet 101 in equal and opposite directions, as shown by arrows 2102 and 2106 in FIG. 21. In this manner, each slave section coupled to the angled gears 1902 (e.g., sections 102 and 106 in FIG. 21) rotate simultaneously with the corresponding angled gear 1902. For example, section 102 rotates in the direction shown by arrow 2102 and sections 106 rotates in the direction shown by arrow 2106.

Figure 22:
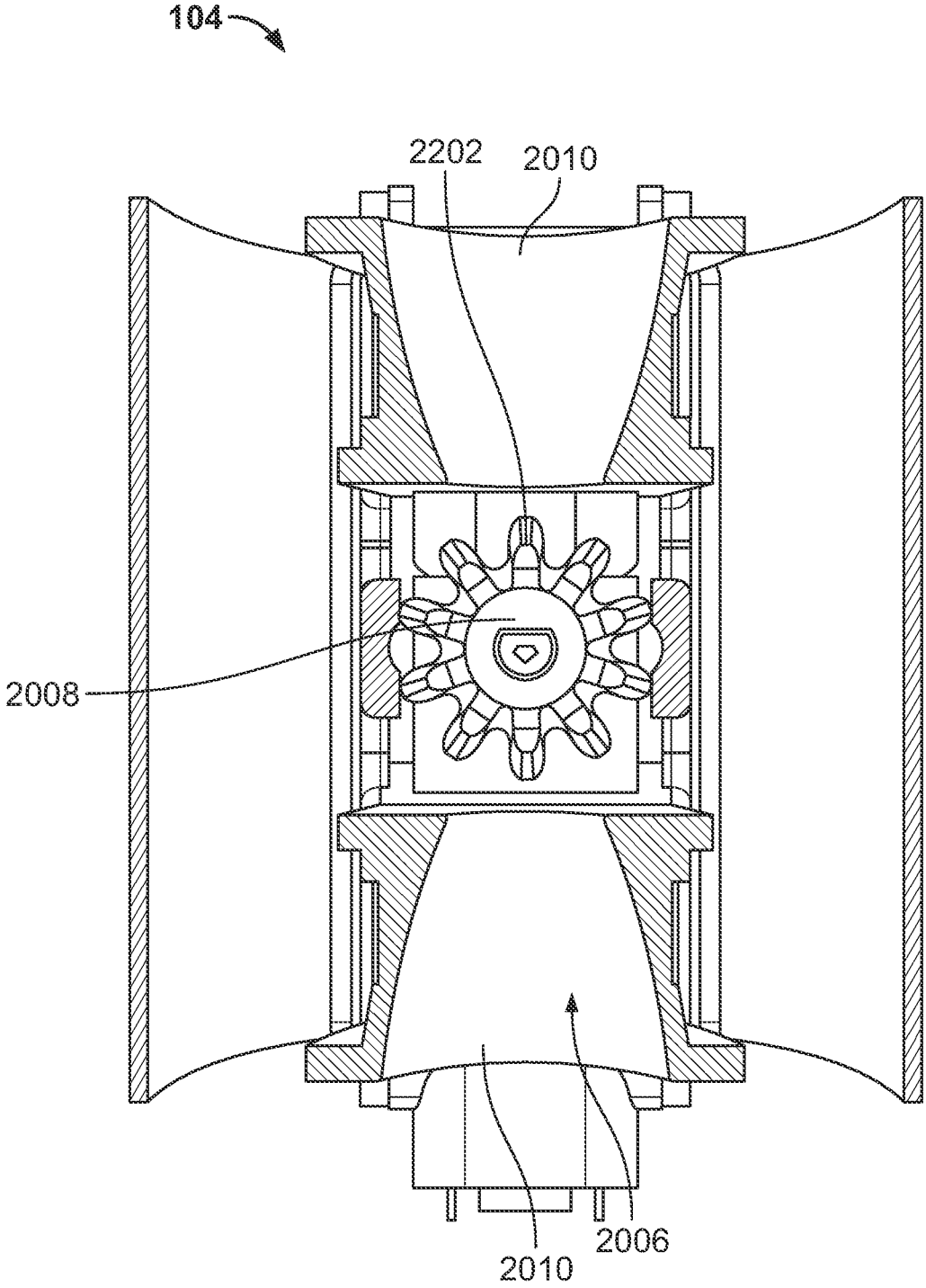
FIG. 22 is a front cross-sectional view of an interior portion of a faucet, according to an exemplary embodiment.

FIG. 22 illustrates a front cross-sectional view of the drive section 104 and FIG. 23 illustrates a side cross-section view of the drive section 104, according to an exemplary embodiment. As shown in FIGS. 22 and 23, the drive gear 2008 may be disposed along a side portion of the drive section 104 such that the teeth of the drive gear 2008 (shown as teeth 2202 in FIG. 22) may engage with the teeth of each angled gear 1902. In various embodiments, the teeth 2202 of the drive gear 2008 may be disposed at an angle relative to the rotational axis of the drive gear 2008 to make contact with the angled teeth of each angled gear 1902.

As shown in FIGS. 19-23, and among others, each section includes an angled end portion 1906. Each section may have an elliptical cross-section along a first cross-sectional plane perpendicular to the longitudinal axis of the section. However, each section may have a circular cross-section along a second cross-sectional plane parallel to the angled end portion 1906. In other words, the perimeter of each angled end portion 1906 may be circular along the second cross-sectional plane aligned with the angled end portion 1906. Advantageously, this allows adjacent sections to rotate relative to each other while the circular perimeters of their angled end portions 1906 remain aligned along their entire perimeters. In various embodiments, the angled end portion 1906 can be substantially parallel to each corresponding angled gear 1902, as shown throughout the figures. Such configuration allows for each section to rotate an angle (e.g., at the angle of the angled gears 1902, as discussed above). For example, section 102 rotates relative to the drive section 104 (e.g., about center axis 2310) at an angle between the center axis of section the drive section 104, as shown by the angle between axis 2306 (the center axis of the angled gear 1902) and axis 2310 (the center axis of the drive section 104). Similarly, section 106 rotates relative to the drive section 104 (e.g., about center axis 2310) at an angle between the center axis of section 106, as shown by the angle between axis 2308 (the center axis of the angled gear 1902) and axis 2310 (the center axis of the drive section 104). This angular rotation between each section causes the overall shape of the faucet 101 to change, as shown throughout FIGS. 1-8, without causing misalignment or detachment of the sections relative to one another (e.g., an angled gear 1902 of a slave section remains coupled with a portion of a drive section, such as through the bearing component 2010, etc.)

While the drive gear 2008 shown throughout the embodiments in the figures is a pinion gear and the angled gears 1902 shown throughout the embodiments in the figures are beveled gears, various other types of gears may be used to operate the faucet including, but not limited to, spur gears, helical gears, worm gears, rack and pinion gears, or the like.

The drive gear 2008 can be operated through various means including, but not limited to, pneumatic power or electrical motors. For example, the faucet assembly 100 may include one or more wires or cables that run through a portion of each section to operably couple the one or more motors with an electrical power source. In another example, the faucet assembly 100 may include one or more cables, conduits, or the like to provide gas, pressurized air, or the like to the sections to facilitate operating the faucet assembly 100 pneumatically.

In various embodiments, the faucet assembly 100 may include one or more safety features or components. For example, the faucet assembly 100 may include one or more pressure sensors to facilitate detecting a pressure placed on a portion of the faucet 101 in a moving or rotating position. The faucet assembly 100 may include one or more control systems communicably coupled to the sensor or other portions of the faucet assembly 100 to facilitate controlling the faucet 101. In such manner, the faucet assembly 100 may be configured to detect a user interacting with the faucet 101 during movement or rotation (e.g., while the faucet 101 is moving between the first and second location, while one or more sections are rotating) and subsequently cause the faucet assembly 100 to cease operation (e.g., stop moving, stop rotating). Such configuration may provide a safety mechanism to facilitate protecting a user of the faucet assembly 100 from harm (e.g., from pinching a portion of a hand, from excess heat exposure of electrical current, etc.).

While only one drive section and two slave sections were described and shown throughout FIGS. 19-23, the same configuration of sections can be continued throughout a plurality of similarly coupled sections create the faucet 101. For example, the section 106 shown in FIGS. 19-23 may include a second angled gear 1902 coupled to a second end of the section 106 and configured to engage with a second drive gear 2008 coupled to another drive section (e.g., such as section 108 shown in FIGS. 1-5). Similarly, section 108 can then couple to another slave section (e.g., such as section 110) having one or more angled gears 1902. It is important to note that each section can include either a drive section configuration or a slave section configuration. For example, in the embodiment shown in FIG. 4, section 104 may be either a drive section or a slave section. Similarly, section 106 may be either a drive section or a slave section, etc. In various embodiments, every other section may change between a drive section and a slave section. For example, still referring to the embodiment shown in FIG. 4, section 104 may be a drive section, section 106 may be a slave section, section 108 may be a drive section, etc.

FIGS. 24-27 illustrate an exemplary embodiment of an articulating sink assembly that can be optionally used in combination with the faucet assemblies described herein. Sink assembly 200 can include a cabinet 91 with the countertop 90 and a base 202 moveably mounted therein via a lift assembly (not shown), such as the exemplary lift assemblies described herein. In an exemplary embodiment, sink base 202 can be shiftable between multiple positions or depths with respect to countertop 90. As shown in FIG. 24, the sink base 202 can assume a first position in which a top surface 204 of the sink base 202 is flush with the countertop 90, such that the sink assembly 200 is obscure or hidden, and the sink base 202 can be used as a working surface. In one non-limiting exemplary embodiment, the sink base 202 can be formed of a same or similar material as the countertop 90, or alternatively, the sink base 202 can be formed of a different material than the countertop 90.

As depicted in FIG. 24, the sink base 202 is bounded on one or more sides by a perimeter drain 206, which allows fluid to drain around the sink base 202. Additionally or alternatively, the sink base 202 can include one or more drain holes (not shown) that allow fluid to drain from the sink base 202 into a bottom portion (not shown) of the sink assembly 200. In addition or alternatively, the bottom portion 208 can include one or more drain holes 209 that allow fluid to drain from the sink assembly 200. The drain holes, whether positioned in the sink base 202 or the bottom portion 208, can be optionally shiftable between an open position in which fluid is to drain therethrough, and a closed position in which fluid is prevented from draining therethrough.

As depicted in FIG. 25, the sink base 202 is movable to a second position in which the top surface 204 is spaced below the countertop 90 and above the bottom portion 208, thereby defining a bottom surface of a sink basin 210 along with side walls 212 of the cabinet 91. In this embodiment, a kinetic faucet 100, such as those described herein, can be actuated into a use position as shown, such that the sink assembly 200 can be used as a sink basin even if the sink base 202 is not positioned at the bottom portion 208 of the cabinet 91, or the kinetic faucet 100 can remain in an unused, hidden position, or other position. In an exemplary embodiment, the sink base 202 can be moved at any of a number of positions along a depth of the sink assembly 200 as determined by a user. In an alternative embodiment, the sink base 202 can be moved to one or more predetermined or preprogrammed positions along the depth of the sink assembly 200.

Figure 26:
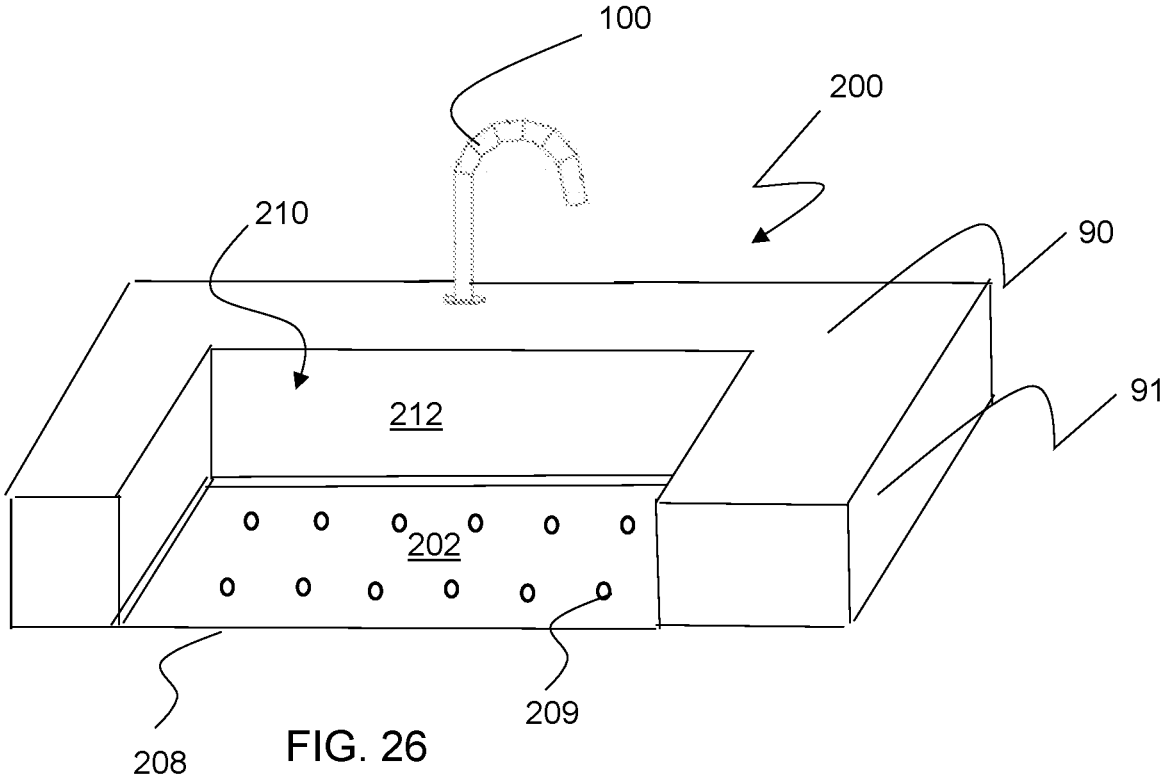
FIG. 26 is a front cross-sectional view of an interior portion of a movable sink assembly in a third position, according to an exemplary embodiment.

As depicted in FIG. 26, the sink base 202 is movable to yet another position in which the sink base 202 is adjacent the bottom portion 208, thereby forming a deeper sink basin 210 than the basin depicted in FIG. 25. In this embodiment, a kinetic faucet 100, such as those described herein, can be actuated into a use position as shown, such that the sink assembly 200 can be used as a sink basin even if the sink base 202 is not positioned at the bottom portion 208 of the cabinet 91, or the kinetic faucet 100 can remain in an unused, hidden position, or other position.

In other exemplary embodiments not shown, the sink base can also be movable in a lateral direction, such as in a pocket formed within the side of the cabinet or countertop, or slidable over the top of the countertop. In another exemplary embodiment, separate sections of the sink base are independently movable with respect to each other such that only a portion of the sink base is lowered for a smaller basin, or sections are a different heights, thereby creating a multiple basin sink. In all embodiments, the sink assembly is movable via voice activation, remote activation, motion sensing, and/or button or switch activated.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the articulating faucets as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Other substitutions, modifications, changes and omissions may also be made in the design, operating conditions and arrangement of the various exemplary embodiments without departing from the scope of the present invention. For example, any element (e.g., base, spout, section, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A faucet assembly comprising:

a faucet, comprising:

a base configured to movably couple to a mounting surface;

a spout rotatably coupled to the base, the spout having a plurality of conduits each rotatably coupled to each other by an angled joint;

wherein the spout extends from the base to a free end comprising an outlet to discharge a fluid; and wherein a first conduit of the plurality of conduits is configured to rotate relative to the base from a first rotational position towards a second rotational position and a second conduit of the plurality of conduits is configured to rotate relative to the first conduit in response to a rotation of the first conduit.

2. The faucet assembly of claim 1, wherein the first conduit rotates in a first rotational direction relative to the base and the second conduit rotates in a second rotational direction opposite the first rotational direction relative to the first conduit.

3. The faucet assembly of claim 1, further comprising a third conduit and a fourth conduit of the plurality of conduits, wherein the third conduit is configured to rotate relative to the second conduit and the fourth conduit is configured to rotate in response to a rotation of the third conduit.

4. The faucet assembly of claim 1, wherein the first conduit includes an actuator assembly configured to cause the second conduit to rotate.

5. The faucet assembly of claim 4, wherein the actuator assembly includes at least one of an electric actuator or a pneumatic actuator.

6. The faucet assembly of claim 4, wherein the actuator assembly includes a motor, a gear box assembly operably coupled to the motor and to the first conduit, and a power cable operably coupled to the motor and to an interior portion of the first conduit and configured to provide power to the motor.

7. The faucet assembly of claim 1, further comprising a lift assembly disposed on a first side of the mounting surface and configured to move the spout between a first location, wherein the spout is at least partially disposed proximate the first side of the mounting surface, and a second location, wherein the spout is at least partially disposed proximate a second side of the mounting surface.

8. The faucet assembly of claim 7, further comprising a positioning assembly having a guide and a spout positioning attachment, wherein the spout positioning attachment is configured to engage with the guide as the spout moves from the second location to the first location.

9. The faucet assembly of claim 7, wherein the outlet of the spout is disposed proximate the first side of the mounting surface in the first location.

10. The faucet assembly of claim 7, wherein the lift assembly is configured to move the spout to a cleaning position, such that the outlet of the spout is coplanar with the mounting surface.

11. The faucet assembly of claim 1, further comprising a cleaning attachment removably coupled to a portion of the spout.

12. The faucet assembly of claim 11, wherein the cleaning attachment is configured to move between a first cleaning position and a second cleaning position to facilitate cleaning the spout.

13. The faucet assembly of claim 1, wherein the plurality of conduits includes at least four conduits each rotatably coupled to each other.

14. A faucet, comprising:

a base configured to movably couple to a mounting surface having a first side and a second side;

a spout rotatably coupled to the base, the spout having a plurality of conduits each rotatably coupled to each other by an angled joint;

wherein the spout extends from the base to a free end comprising an outlet to discharge a fluid; and wherein a first conduit of the plurality of conduits is configured to rotate relative to the base from a first rotational position towards a second rotational position and a second conduit of the plurality of conduits is configured to rotate relative to the first conduit in response to a rotation of the first conduit.

15. The faucet of claim 14, wherein the first conduit rotates in a first rotational direction and the second conduit rotates in a second rotational direction and the second rotational direction differs from the first rotational direction.

16. The faucet of claim 14, further comprising a third conduit and a fourth conduit of the plurality of conduits, wherein the third conduit is configured to rotate relative to the second conduit and the fourth conduit is configured to rotate in response to a rotation of the third conduit.

17. The faucet of claim 14, wherein the first conduit includes an actuator assembly having at least one or an electric actuator or a pneumatic actuator configured to cause the second conduit to rotate.

18. The faucet of claim 17, wherein the first conduit includes a pinion gear operably coupled to the actuator assembly and configured to engage with an angled bevel gear rigidly coupled to the second conduit.

19. The faucet of claim 18, wherein the pinion gear engages with the angled bevel gear such that actuation of the actuator assembly causes the pinion gear and the angled bevel gear to rotate.

20. The faucet of claim 14, wherein the plurality of conduits includes at least four conduits each rotatably coupled to each other.

21. The faucet of claim 14, wherein the spout includes a cylindrical shape and wherein each conduit of the plurality of conduits includes an elliptical cross-section.

* * * * *